US010649350B2

(12) United States Patent
Yamaguchi et al.

(10) Patent No.: US 10,649,350 B2
(45) Date of Patent: May 12, 2020

(54) ELECTROPHOTOGRAPHIC MEMBER, PROCESS CARTRIDGE AND ELECTROPHOTOGRAPHIC APPARATUS

(71) Applicant: CANON KABUSHIKI KAISHA, Tokyo (JP)

(72) Inventors: Sosuke Yamaguchi, Susono (JP); Masaki Yamada, Mishima (JP); Kazuhiro Yamauchi, Suntou-gun (JP); Satoru Nishioka, Suntou-gun (JP); Taichi Shintou, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 643 days.

(21) Appl. No.: 14/715,477

(22) Filed: May 18, 2015

(65) Prior Publication Data

US 2015/0331342 A1 Nov. 19, 2015

(30) Foreign Application Priority Data

May 15, 2014 (JP) ..... 2014-101642
May 12, 2015 (JP) ..... 2015-097742

(51) Int. Cl.
*B05C 1/08* (2006.01)
*G03G 15/08* (2006.01)
(Continued)

(52) U.S. Cl.
CPC ..... *G03G 5/043* (2013.01); *G03G 15/75* (2013.01)

(58) Field of Classification Search
None
See application file for complete search history.

(56) References Cited

U.S. PATENT DOCUMENTS 2,957,832 A * 10/1960 Gmitter ..... C08G 18/2018 521/128
4,322,327 A * 3/1982 Yoshimura ..... C08G 18/0819 523/130

(Continued)

FOREIGN PATENT DOCUMENTS

CN 103492956 1/2014
EP 2 693 274 2/2014

(Continued)

OTHER PUBLICATIONS

English Translation of Naito et al. (JP 2005085601), Mar. 2005.*

(Continued)

*Primary Examiner* — Ronak C Patel
(74) *Attorney, Agent, or Firm* — Venable LLP

(57) ABSTRACT

The present invention provides an electrophotographic member having excellent deformation recovery even when stored or used under a high temperature and high humidity environment, which is useful in forming a high-quality electrophotographic image; a process cartridge; and an electrophotographic apparatus. The electrophotographic member of the present invention includes a conductive mandrel and an electro-conductive layer; the electro-conductive layer including a resin synthesized from an ion conducting agent and a compound being able to react with the ion conducting agent; the ion conducting agent including a specific anion and a cation having at least three hydroxyl groups; the compound being able to react with the hydroxyl group.

5 Claims, 3 Drawing Sheets

(51) Int. Cl.

| | |
|---|---|
| ***G03G 15/02*** | (2006.01) |
| ***G03G 5/043*** | (2006.01) |
| ***G03G 15/00*** | (2006.01) |

(56) References Cited

U.S. PATENT DOCUMENTS

| | | | | |
|---|---|---|---|---|
| 6,231,984 | B1 * | 5/2001 | Horibe | B05D 7/586 204/478 |
| 2007/0152193 | A1 * | 7/2007 | Isayama | C08G 18/4812 252/500 |
| 2010/0093951 | A1 * | 4/2010 | Oikawa | C08F 283/12 525/474 |
| 2010/0226684 | A1 * | 9/2010 | Mayuzumi | G03G 15/0233 492/18 |
| 2012/0195631 | A1 * | 8/2012 | Yamada | G03G 15/0818 399/111 |
| 2012/0251171 | A1 | 10/2012 | Muranaka et al. | |
| 2013/0281275 | A1 | 10/2013 | Nishioka et al. | |
| 2013/0315620 | A1 * | 11/2013 | Kikuchi | G03G 15/751 399/111 |

FOREIGN PATENT DOCUMENTS

| | | | |
|---|---|---|---|
| JP | 57-5047 | A | 1/1982 |
| JP | 11-209633 | A | 8/1999 |
| JP | 2011-118113 | A | 6/2011 |
| JP | 2013-148866 | A | 8/2013 |
| JP | 2014-065811 | | 4/2014 |

OTHER PUBLICATIONS

English Abstract of Li et al. CN 103319683 (Year: 2013).*
European Search Report dated Oct. 30, 2015 in European Application No. 15167856.2.
U.S. Appl. No. 14/708,940, filed May 11, 2015. Inventor: Masaki Yamada, et al.
U.S. Appl. No. 14/708,981, filed May 11, 2015. Inventor: Masaki Yamada, et al.
U.S. Appl. No. 14/710,579, filed May 12, 2015. Inventor: Hideya Arimura, et al.
U.S. Appl. No. 14/709,155, filed May 11, 2015. Inventor: Satoru Nishioka, et al.

* cited by examiner

ELECTROPHOTOGRAPHIC MEMBER, PROCESS CARTRIDGE AND ELECTROPHOTOGRAPHIC APPARATUS

BACKGROUND OF THE INVENTION

Field of the Invention

The present invention relates to an electrophotographic member for use in an electrophotographic apparatus, a process cartridge having the electrophotographic member, and an electrophotographic apparatus.

Description of the Related Art

In an electrophotographic apparatus (a copier, a facsimile, a printer, and the like using an electrophotographic system), an electrophotographic photosensitive member (hereinafter also referred to as "photosensitive member") is charged with a charging roller and exposed with a laser beam or the like, so that an electrostatic latent image is formed on the photosensitive member. Subsequently, toner in a developing container is applied onto a developing roller with a toner supply roller and a toner regulating member. Using the toner transported to a development region with the developing roller, the electrostatic latent image on the photosensitive member is developed at the contact part or the proximity part between the photosensitive member and the developing roller. Subsequently, the toner on the photosensitive member is transferred to a recording paper with a transfer unit and fixed with heat and pressure. On the other hand, the toner remaining on the photosensitive member is removed with a cleaning blade.

In an electrophotographic apparatus, a conductive roller having an electro-conductive layer for use as developing roller or charging roller is required to have uniform and stable electric properties. Examples of the electro-conductive agent for use in imparting predetermined conductive properties to the electro-conductive layer include an ion conducting agent such as quaternary ammonium salt. The electro-conductive layer made conductive with the ion conducting agent has the ion conducting agent dispersed in a molecular level in the electro-conductive layer, so that the effects of the variation in the amount added and the process history on the electrical resistivity is smaller in comparison with an electro-conductive layer made from conductive particles such as carbon black. Consequently the electro-conductive layer has a uniform electrical resistance over the entire region, so that the developing roller enables uniform development of a developer on a photosensitive member and the charging roller enables uniform charging of the surface of a photosensitive member.

On the other hand, due to having migration properties, the ion conducting agent tends to migrate in the electro-conductive layer and exude from the surface. Due to the migration of the ion conducting agent in the electro-conductive layer, the electrical resistivity of a conductive roller changes over time in some cases. In addition, the ion conducting agent exuding from the surface adheres to the surface of a photosensitive member or the like in contact with the conductive roller, affecting the quality of an electrophotographic image in some cases.

Responding to the problem, in Japanese Patent Application Laid-Open No. 2011-118113, use of an ionic liquid having two hydroxyl groups allows the ionic liquid to be fixed to a urethane resin composition for preventing the ion conducting agent from exuding.

Further, in Japanese Patent Application Laid-Open No. H11-209633, a conductive material including a quaternary ammonium salt to which an ether structure is added is described as a conductivity imparting agent. According to the description, use of a quaternary ammonium salt having three hydroxyl groups, in particular, improves the durability under conduction of the conductive material. Herein, the durability under conduction means the small variation in electrical resistivity, when the conductive material is subjected to conduction for a long time.

According to the study by the present inventors, an electro-conductive layer including an ion conducting agent having two hydroxyl groups prevents the ion conducting agent from exuding from the electro-conductive layer due to fixation of the ion conducting agent to the electro-conductive layer. However, when the electro-conductive layer is left standing under a high temperature and high humidity environment for a long period, the photographic image is impaired due to residual deformation at the contact part with another member in some cases. Also, the electro-conductive layer including an ion conducting agent having three hydroxyl groups further prevents the ion conducting agent from exuding. Depending on the kind of anion of an ion conducting agent, however, when the electro-conductive layer is left standing under a high temperature and high humidity environment for a long period, the photographic image is impaired due to residual deformation at the contact part with another member in some cases.

SUMMARY OF THE INVENTION

The present invention is directed to providing an electrophotographic member having excellent deformation recovery even when stored or used under a high temperature and high humidity environment, which is useful in forming a high-quality electrophotographic image.

Further, the present invention is directed to providing an electrophotographic apparatus capable of stably outputting a high-quality electrophotographic image, and a process cartridge for use in the electrophotographic apparatus.

The present inventors performed extensive study for achieving the objects. Consequently it was found that an electrophotographic member having an electro-conductive layer with a specific composition has excellent deformation recovery when stored in a high temperature and high humidity environment for a long period, thereby accomplishing the present invention.

According to one aspect of the present invention, there is provided an electrophotographic member including a conductive mandrel and an electro-conductive layer; the electro-conductive layer including a resin synthesized from an ion conducting agent and a compound being able to react with the ion conducting agent; the ion conducting agent including an anion and a cation having at least three hydroxyl groups; the compound being able to react with the hydroxyl group; the anion being at least one selected from the group consisting of a fluorinated sulfonate anion, a fluorinated carboxylate anion, a fluorinated sulfonylimide anion, a fluorinated sulfonylmethide anion, a dicyanamide anion, a fluorinated alkylfluoroborate anion, a fluorinated phosphate anion, a fluorinated antimonate anion, a fluorinated arsenate anion, and bis(oxalato)borate anion.

Further, according to another aspect of the present invention, there is provided an electrophotographic member including a conductive mandrel and an electro-conductive layer, the electro-conductive layer including a resin having a cationic structure in the branched portion of a polymer chain and at least one anion selected from the group consisting of a fluorinated sulfonate anion, a fluorinated carboxylate anion, a fluorinated sulfonylimide anion, a fluorinated sulfonylmethide anion, a dicyanamide anion, a fluorinated alkylfluoroborate anion, a fluorinated phosphate anion, a fluorinated antimonate anion, a fluorinated arsenate anion, and bis(oxalato)borate anion.

Further, according to further aspect of the present invention, there is provided a process cartridge including at least one of a charging member and a developing member, being adapted to be detachably attached to the main body of an electrophotographic apparatus, the charging member or the developing member being the electrophotographic member.

Further, according to further aspect of the present invention, there is provided an electrophotographic apparatus including an electrophotographic photosensitive member, a charging member and a developing member, the charging member or the developing member being the electrophotographic member.

According to the present invention, due to a resin having a specific structure provided in an electro-conductive layer, the deformation recovery when stored under a high temperature and high humidity environment can be maintained at a high level, so that an electrophotographic member useful in forming a high-quality electrophotographic image can be produced.

Further, according to the present invention, a process cartridge and an electrophotographic apparatus capable of stably forming a high-quality electrophotographic image can be obtained.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1A:
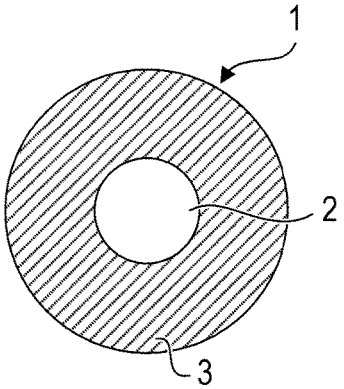
FIG. 1A is a conceptual diagram illustrating an example of the electrophotographic member of the present invention.
Figure 1B:
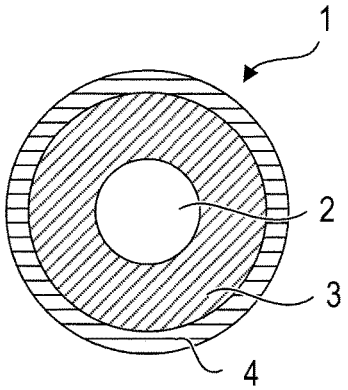
FIG. 1B is a conceptual diagram illustrating another example of the electrophotographic member of the present invention.

The electrophotographic member of the present invention includes a conductive mandrel and an electro-conductive layer. An embodiment of the electrophotographic member for use as a conductive roller is illustrated in each of FIG. 1A, FIG. 1B and FIG. 1C. As illustrated in FIG. 1A, the conductive roller 1 may include a conductive mandrel 2 and an elastic layer 3 disposed on the outer periphery thereof. In this case, the elastic layer 3 is an electro-conductive layer made of a resin synthesized from an ion conducting agent and a compound being able to react with the ion conducting agent. As illustrated in FIG. 1B, a surface layer 4 may be formed on the surface of the elastic layer 3. In this case, the electro-conductive layer may be used in any of the elastic layer 3 and the surface layer 4.

Figure 1C:
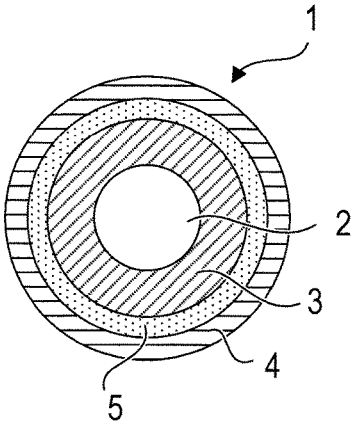
FIG. 1C is a conceptual diagram illustrating further another example of the electrophotographic member of the present invention.

Further, as illustrated in FIG. 1C, a three-layer structure having an intermediate layer 5 between an elastic layer 3 and a surface layer 4, or a multi-layer structure having a plurality of intermediate layers 5 may be employed. In this case, the electro-conductive layer may be used in any of the elastic layer 3, the intermediate layer 5 and the surface layer 4.

The electrophotographic member of the present invention may be used as a charging member or a developing member. The conductive roller may be used as a charging roller or a developing roller.

<Mandel>

A mandrel 2 functioning as an electrode and a supporting member of a conductive roller 1 is made of conductive material such as a metal or alloy, e.g. aluminum, copper alloy and stainless steel; iron plated with chromium or nickel; and synthesized resin having conductivity; which may be solid or hollow.

<Electro-Conductive Layer>

In the present invention, a cation means a cation part contained in an ion conducting agent for synthesizing the resin to be contained in an electro-conductive layer, in a state before reacting with a compound being able to react with a hydroxyl group.

Further, a cationic structure means a portion of the resin contained in the electro-conductive layer synthesized from the ion conducting agent and the compound being able to react with the ion conducting agent. The cationic structure is a residue derived from the ion conducting agent, bonding to other portions of the resin at a plurality of sites.

The electro-conductive layer of the present invention includes a resin synthesized from the ion conducting agent and the compound being able to react with the ion conducting agent. The ion conducting agent includes an anion and a cation having at least three hydroxyl groups. The compound being able to react with the ion conducting agent reacts with the hydroxyl groups which the cation of the ion conducting agent has. The anion is at least one selected from the group consisting of a fluorinated sulfonate anion, a fluorinated carboxylate anion, a fluorinated sulfonylimide anion, a fluorinated sulfonylmethide anion, a dicyanamide anion, a fluorinated alkylfluoroborate anion, a fluorinated phosphate anion, a fluorinated antimonate anion, a fluorinated arsenate anion, and bis(oxalato)borate anion.

Further, the electro-conductive layer of the present invention includes the resin having the cationic structure in the branched portion of a polymer chain and at least one anion selected from the group consisting of a fluorinated sulfonate anion, a fluorinated carboxylate anion, a fluorinated sulfonylimide anion, a fluorinated sulfonylmethide anion, a dicyanamide anion, a fluorinated alkylfluoroborate anion, a fluorinated phosphate anion, a fluorinated antimonate anion, a fluorinated arsenate anion, and bis(oxalato)borate anion.

The ion conducting agent and the compound being able to react with the ion conducting agent of the present invention are essential materials to obtain a resin having a cationic structure in the branched portion of a polymer chain.

The compound being able to react with a hydroxyl group means a compound including two or more functional groups which react with a hydroxyl group in a molecule. The compound being able to react with a hydroxyl group may react not only with the hydroxyl group of the ion conducting agent but also with the hydroxyl group of a polyol or another compound in an electro-conductive layer. Examples of the compound being able to react with a hydroxyl group include an isocyanate compound, a carboxylic acid compound, an epoxide compound and a melamine compound. Examples of the isocyanate compound include: an aliphatic polyisocyanate such as ethylene diisocyanate, and 1,6-hexamethylene diisocyanate (HDI); alicyclic polyisocyanate such as isophorone diisocyanate (IPDI), cyclohexane-1,3-diisocyanate, and cyclohexane-1,4-diisocyanate; an aromatic isocyanate such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate; copolymers thereof; and isocyanurate compounds such as isocyanurate forms, TMP adduct forms, and biuret forms and blocked forms thereof. Examples of the carboxylic acid compound include: an aliphatic dicarboxylic acid such as adipic acid, sebacic acid, malonic acid, 1,4-cyclohexane dicarboxylic acid, and hexahydroisophthalic acid; and an aromatic dicarboxylic acid such as orthophthalic acid, isophthalic acid and terephthalic acid. Examples of the epoxide compound include an aliphatic diepoxide such as 1,4-butane diol diglycidyl ether; and an aromatic diepoxide such as bisphenol-A diglycidyl ether. Examples of the melamine compound for use include a methylated-type melamine, butylated-type melamine, imino-type melamine, methylbutyl-mixed melamine and a methylol-type melamine.

In particular, an aromatic isocyanate such as tolylene diisocyanate, diphenylmethane diisocyanate, and polymeric diphenylmethane diisocyanate is more preferably used in terms of the excellent deformation recovery of a resin to be obtained.

In synthesizing a resin to be contained in an electro-conductive layer from an ion conducting agent and a compound being able to react with the ion conducting agent, the resin may be synthesized with further addition of a polyol other than the ion conducting agent for further improving the flexibility of the electro-conductive layer. The polyol has a plurality of hydroxyl groups in a molecule, and the hydroxyl groups react with the compound being able to react with hydroxyl groups. Examples of the polyol include polyether polyol and polyester polyol, though not specifically limited. Examples of the polyether polyol include polyethylene glycol, polypropylene glycol and polytetramethylene glycol. Examples of the polyester polyol which is obtained by the condensation reaction of a diol component such as 1,4-butanediol, 3-methyl-1,4-pentanediol, neopentyl glycol; or triol component such as trimethylolpropane; with dicarboxylic acid such as adipic acid, phthalic anhydride, terephthalic acid, hexahydroxyphthalic acid. The polyether polyol and the polyester polyol may be subjected to chain-growth reaction to form into a prepolymer with an isocyanate such as 2,4-tolylene diisocyanate (TDI), 1,4-diphenylmethane diisocyanate (MDI), and isophorone diisocyanate (IPDI), in advance and as needed.

A general-purpose resin other than the resin of the present invention, a rubber material, a compounding agent, a conductivity imparting agent, a non-conductive filler, a cross-linking agent, and a catalyst may be added to the electro-conductive layer on an as needed basis, to an extent not to impair the effects of the present invention. Examples of the resin to be added include an epoxy resin, a urethane resin, a urea resin, an ester resin, an amide resin, an imide resin, an amide-imide resin, a phenol resin, a vinyl resin, a silicone resin and a fluorine resin, though not specifically limited. Examples of the rubber material include an ethylene-propylene-dien copolymer rubber, an acrylonitrile-butadiene rubber, a chloroprene rubber, a natural rubber, an isoprene rubber, a styrene-butadiene rubber, a silicone rubber, an epichlorohydrin rubber, and a urethane rubber. Examples of the compounding agent include a filler, a softener, a processing aid, tackifier, an antitack agent, and a foaming agent, which are widely used in resins. Examples of the conductivity imparting agent for use include fine particles of: carbon black; a conductive metal such as aluminum and copper; and a conductive metal oxide such as conductive zinc oxide, conductive tin oxide, and conductive titanium oxide. Examples of the non-conductive filler include silica, quartz powder, titanium oxide and calcium carbonate. Examples of the cross-linking agent include tetraethoxysilane, di-t-butylperoxide, 2,5-dimethyl-2,5-di(t-butylperoxy) hexane, and dicumylperoxide, though not specifically limited.

In the case of using an electro-conductive layer as the surface layer of an electrophotographic member which requires surface roughness, fine particles may be added to the electro-conductive layer for control of the roughness. In the case of using the electro-conductive layer as the surface layer of a developing roller, in particular, the fine particles for control of the roughness can have a volume mean particle diameter of 3 to 20 μm so as to obtain a developing roller excellent in transporting a developer. Further, the amount of the fine particles to be added to the electro-conductive layer can be 1 to 50 parts by mass relative to 100 parts by mass of the resin solid content of the electro-conductive layer, for not impairing the effects of the present invention. Examples of the fine particles for use in control of the roughness include fine particles of a polyurethane resin, a polyester resin, a polyether resin, a polyamide resin, an acrylic resin and a phenol resin.

Examples of the method for forming the electro-conductive layer include spraying of a coating material, immersion, and roll coating, though not specifically limited. The immersion coating method in which a coating material overflows from the upper end of an immersion tank as described in Japanese Patent Laid-Open No. S57-5047 is simple and excellent in production stability as a method for forming an electro-conductive layer. Further, as a method for forming an electro-conductive layer in using the electro-conductive layer of the present invention as the elastic layer 3 illustrated in FIG. 1A, a known method may be applied to the conductive roller. Examples of the method include: forming by co-extruding the materials for the mandrel and the electro-conductive layer; and feeding a liquid material for forming an electro-conductive layer in a mold equipped with a cylindrical pipe, pieces disposed at both ends of the pipe for holding a mandrel, and the mandrel, so as to be heat-cured.

<Ion Conducting Agent>

The ion conducting agent for use in an electro-conductive layer has a cation and an anion. The cation has three or more hydroxyl groups in a molecule. The cation includes a cation skeleton and a substituent having a hydroxyl group. The cation may further have a substituent having no hydroxyl group. The substituent having a hydroxyl group and the substituent having no hydroxyl group each bond to a cation skeleton.

Examples of the cation skeleton include: an acyclic cation such as a quaternary ammonium cation, a sulfonium cation, a phosphonium cation; and a nitrogen-containing heterocyclic cation such as an imidazolium cation, a pyridinium cation, a pyrrolidinium cation, a piperidinium cation, a pyrazolium cation, a morpholinium cation, a pyrazolinium cation, a hydroimidazolium cation, a triazolium cation, a pyridazinium cation, a pyrimidinium cation, a pyrazinium cation, a triazolium cation, an oxazolium cation, an indolium cation, a quinolinium cation, an isoquinolinium cation and a quinoxalinium cation.

In particular, an electro-conductive layer using an ion conducting agent having a nitrogen atom in the cation skeleton such as a quaternary ammonium cation and a nitrogen-containing heterocyclic cation is preferred in terms of achieving relatively high conductivity in comparison with an electro-conductive layer using an ion conducting agent having no nitrogen atom in the cation skeleton (e.g. a sulfonium cation and a phosphonium cation). In particular, the ion conducting agent having the quaternary ammonium cation or the imidazolium cation allows the electro-conductive layer excellent in conductivity to be produced even with a small amount added. The addition of the ion conducting agent having the quaternary ammonium cation and the imidazolium cation to the electro-conductive layer is, therefore, particularly preferred, in terms of achieving extremely small reduction in the deformation recovery of an electrophotographic member after a long-term storage under a high temperature and high humidity environment.

As described above, the cation of the ion conducting agent can be a quaternary ammonium cation having at least three hydroxyl groups, a nitrogen-containing heterocyclic cation having at least three hydroxyl groups, or an imidazolium cation having at least three hydroxyl groups.

The cation includes two or more substituents having a hydroxyl group. Herein, the term "substituent having a hydroxyl group" means a substituent having one or more hydroxyl groups. The substituent having a hydroxyl group is selected such that at least three hydroxyl groups bond to one cation skeleton. It is more preferred as the number of hydroxyl groups increases. The substituent having a hydroxyl group may have the hydroxyl group directly bonding to a cation skeleton, such as hydroxypyridinium and hydroxyimidazolium; or may have the hydroxyl group bonding to the cation skeleton through a linking group such as a hydrocarbon group and an alkoxy group.

The hydroxyl group bonding to the cation skeleton through the linking group is preferred due to a relatively high reactivity of the hydroxyl group. Examples of the linking group for bonding the hydroxyl group to the cation skeleton include the hydrocarbon group, a substituent having an alkylene ether group, and a substituent having a branched structure.

The hydrocarbon group may be a hydrocarbon group having 1 to 30 carbon atoms such as a methylene group, an ethylene group, a propylene group, a butylene group, a pentylene group, a hexylene group and a phenylene group, and may have a hetero atom and another functional group having no hydroxyl group (e.g. a hydrocarbon group having 1 to 30 carbon atoms, a halogen group such as fluorine, chlorine, bromine and iodine, an alkoxy group such as a methoxy group and an ethoxy group, a substituent including a hetero atom such as an amide group and a cyano group, and a haloalkyl group such as trifluoromethyl group).

Examples of the substituent having an alkylene ether group include an alkylene ether group having a degree of polymerization of 1 to 10 such as oligo(ethylene glycol), oligo(propylene glycol) and oligo(tetramethylene glycol).

The substituent having a branched structure is a substituent having one cation skeleton to which a plurality of hydroxyl groups bond through a plurality of the linking groups, with carbon atoms or nitrogen atoms as the branch points, and examples thereof include a 1,2-propanediol group, a [bis(2-hydroxyethyl)amino]ethylene group, and a 2,2-bis(hydroxymethyl)-3-hydroxypropyl group.

The cation of the ion conduction agent may include, in addition to a substituent having a hydroxyl group, one or more substituents having no hydroxyl group (e.g. a hydrocarbon group having 1 to 30 carbon atoms, a halogen group such as fluorine, chlorine, bromine and iodine, an alkoxy group such as a methoxy group and an ethoxy group, a substituent including a hetero atom such as an amide group and a cyano group, and a haloalkyl group such as a trifluoromethyl group).

The anion of the ion conducting agent is selected from the group consisting of a fluorinated sulfonate anion, a fluorinated carboxylate anion, a fluorinated sulfonylimide anion, a fluorinated sulfonylmethide anion, a fluorinated alkylfluoroborate anion, a fluorinated phosphate anion, a fluorinated antimonate anion, a fluorinated arsenate anion, a dicyanamide anion, and a bis(oxalato)borate anion.

Examples of the fluorinated sulfonate anion include a trifluoromethane sulfonate anion, a fluoromethane sulfonate anion, a perfluoroethyl sulfonate anion, a perfluoropropyl sulfonate anion, a perfluorobutyl sulfonate anion, a perfluoropentyl sulfonate anion, a perfluorohexyl sulfonate anion, and a perfluorooctyl sulfonate anion.

Examples of the fluorinated carboxylate anion include a trifluoroacetate anion, a perfluoropropionate anion, a perfluorobutyrate anion, a perfluorovalerate anion and a perfluorocaproate anion.

Examples of the fluorinated sulfonylimide anion include an anion such as a trifluoromethanesulfonylimide anion, a perfluoroethylsulfonylimide anion, a perfluoropropylsulfonylimide anion, a perfluorobutylsulfonylimide anion, a perfluoropentylsulfonylimide anion, a perfluorohexylsulfonylimide anion, a perfluorooctylsulfonylimide anion, a fluorosulfonylimide anion, and a cyclic anion such as a cyclo-hexafluoropropane-1,3-bis(sulfonyl)imide anion.

Examples of the fluorinated sulfonylmethide anion include a trifluoromethane sulfonylmethide anion, a perfluoroethyl sulfonylmethide anion, a perfluoropropyl sulfonylmethide anion, a perfluorobutyl sulfonylmethide anion, a perfluoropentyl sulfonylmethide anion, a perfluorohexyl sulfonylmethide anion, and a perfluorooctyl sulfonylmethide anion.

Examples of the fluorinated alkyl fluoroborate anion include a trifluoromethyl trifluoroborate anion and a perfluoroethyl trifluoroborate anion.

Examples of the fluorinated phosphate anion include a hexafluorophosphate anion, a tris-trifluoromethyl-trifluorophosphate anion, and a tris-perfluoroethyl-trifluorophosphate anion.

Examples of the fluorinated antimonate anion include a hexafluoroantimonate anion and a trifluoromethyl-pentafluoroantimonate anion.

Examples of the fluorinated arsenate anion include a hexafluoroarsenate anion and a trifluoromethyl-pentafluoroarsenate anion.

Examples of the other anion include a dicyanamide anion and a bis(oxalato)borate anion.

In particular, an anion having an electron drawing fluorinated sulfonyl group such as the fluorinated sulfonate anion, a fluorinated sulfonylimide anion, and a fluorinated sulfonylmethide anion is preferred as the anion of an ion conducting agent, in terms of achieving a desired conductivity with a relatively small amount of content in an electro-conductive layer.

The amount of the ion conducting agent blended can be 0.01 parts by mass or more and 20 parts by mass or less relative to 100 parts by mass of an electro-conductive layer. With an amount of 0.01 parts by mass or more, an electro-conductive layer having high conductivity can be obtained, and with an amount of 20 parts by mass or less, the electro-conductive layer particularly excellent in deformation recovery can be obtained.

The resin of the present invention is synthesized from an ion conducting agent and a compound being able to react with the ion conducting agent. The ion conducting agent includes an anion and a cation having at least three hydroxyl groups. The compound being able to react with the ion conducting agent is the compound being able to react with a hydroxyl group of the cation of the ion conducting agent.

The resin of the present invention is obtained by a reaction of an ion conducting agent having at least three hydroxyl groups and a compound being able to react with an ion conducting agent. Accordingly the resin of the present invention may include at least one cationic structure selected from the group consisting of the following Formulas (1) to (13).

Formula (1)

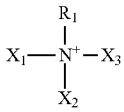

In Formula (1), $X_1$ to $X_3$ each independently represent a structure including a portion bonding to a resin through a bond selected from the group consisting of an ether bond, an ester bond and a urethane bond. $R_1$ represents one selected from the group consisting of the following (a) to (c):

(a) a hydrogen atom;

(b) a hydrocarbon group having 1 to 30 carbon atoms; and (c) a structure including a portion bonding to a resin through a bond selected from the group consisting of an ether bond, an ester bond and a urethane bond.

Formula (2)

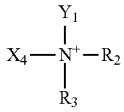

In Formula (2), $R_2$ and $R_3$ each independently represent one selected from the group consisting of the following (a) to (c):

(a) a hydrogen atom;

(b) a hydrocarbon group having 1 to 30 carbon atoms; and (c) a structure including a portion bonding to a resin through a bond selected from the group consisting of an ether bond, an ester bond and a urethane bond.

$X_4$ represents a structure including a portion bonding to a resin through a bond selected from the group consisting of an ether bond, an ester bond and a urethane bond. $Y_1$ represents one selected from the group consisting of Ya and Yb in the following Formulas (14) and (15).

Formula (14)

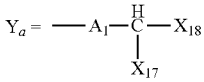

-continued

Formula (15)

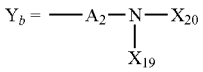

In Formulas (14) and (15), $A_1$ and $A_2$ each independently represent a hydrocarbon group or an alkylene ether group. $X_{17}$ to $X_{20}$ each independently represent a structure including a portion bonding to a resin through a bond selected from the group consisting of an ether bond, an ester bond and a urethane bond.

Formula (3)

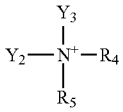

In Formula (3), $Y_2$ and $Y_3$ each represent one selected from the group consisting of Ya and Yb in Formulas (14) and (15). $R_4$ and $R_5$ each independently represent one selected from the group consisting of the following (a) to (c):

(a) a hydrogen atom;

(b) a hydrocarbon group having 1 to 30 carbon atoms; and (c) a structure including a portion bonding to a resin through a bond selected from the group consisting of an ether bond, an ester bond, and a urethane bond.

Formula (4)

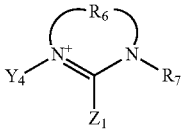

In Formula (4), $Y_4$ represents one selected from the group consisting of Ya and Yb in Formulas (14) and (15). $R_6$ represents a hydrocarbylene group having 1 to 3 carbon atoms, and may include a hetero atom. The hydrocarbylene group is herein defined as a divalent hydrocarbon group. Specific examples thereof include a methylene group ($—CH_2—$), an ethylene group ($—CH_2CH_2—$), and propane-1,3-diyl group ($—CH_2CH_2—CH_2—$).

$R_7$ represents a structure including a portion bonding to a resin through a bond selected from the group consisting of an ether bond, an ester bond and a urethane bond.

$Z_1$ represents one selected from the group consisting of a hydrogen atom and a hydrocarbon group having 1 to 30 carbon atoms.

Formula (5)

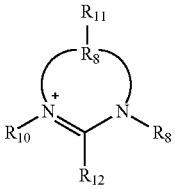

In Formula (5), $R_8$ represents a hydrocarbylene group having 1 to 3 carbon atoms, and may include a hetero atom. $R_9$ and $R_{10}$ each represent a structure including a portion bonding to a resin through a bond selected from the group consisting of an ether bond, an ester bond and a urethane bond, or one selected from the group consisting of Ya and Yb in Formulas (14) and (15). $R_{11}$ and $R_{12}$ each independently represent one selected from the group consisting of the following (a) to (c), provided that at least one of $R_{11}$ and $R_{12}$ is (c):

(a) a hydrogen atom;

(b) a hydrocarbon group having 1 to 30 carbon atoms; and (c) a structure including a portion bonding to a resin through a bond selected from the group consisting of an ether bond, an ester bond and a urethane bond.

Formula (6)

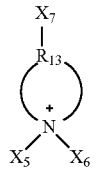

In Formula (6), $R_{13}$ represents a hydrocarbylene group having 3 to 5 carbon atoms, and may include an oxygen atom or a sulfur atom. $X_5$ to $X_7$ each represent a structure including a portion bonding to a resin through a bond selected from the group consisting of an ether bond, an ester bond and a urethane bond.

Formula (7)

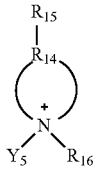

In Formula (7), $R_{14}$ represents a hydrocarbylene group having 3 to 5 carbon atoms, and may include an oxygen atom or a sulfur atom. $R_{15}$ and $R_{16}$ each independently represent one selected from the group consisting of the following (a) to (c), provided that at least one of $R_{15}$ and $R_{16}$ is (c):

(a) a hydrogen atom;

(b) a hydrocarbon group having 1 to 30 carbon atoms; and (c) a structure including a portion bonding to a resin through a bond selected from the group consisting of an ether bond, an ester bond and a urethane bond.

$Y_5$ represents one selected from the group consisting of Ya and Yb in Formulas (14) and (15).

When the nitrogen atom in Formula (7) has a double bond, $R_{16}$ is absent.

Formula (8)

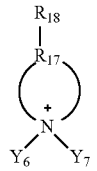

In Formula (8), $R_{17}$ represents a hydrocarbylene group having 3 to 5 carbon atoms, and may include an oxygen atom or a sulfur atom. $R_{18}$ represents one selected from the group consisting of the following (a) to (c):

(a) a hydrogen atom;

(b) a hydrocarbon group having 1 to 30 carbon atoms; and (c) a structure including a portion bonding to a resin through a bond selected from the group consisting of an ether bond, an ester bond, and a urethane bond.

$Y_6$ and $Y_7$ each independently represent one selected from the group consisting of Ya and Yb in Formulas (14) and (15).

Formula (9)

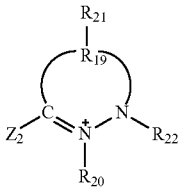

In Formula (9), $R_{19}$ represents a hydrocarbylene group having 1 to 3 carbon atoms, and may include a hetero atom. $R_{20}$ and $R_{22}$ each independently represent a structure including a portion bonding to a resin through a bond selected from the group consisting of an ether bond, an ester bond and a urethane bond, or one selected from the group consisting of Ya and Yb in Formulas (14) and (15), provided that at least one of $R_{20}$ and $R_{22}$ is one selected from the group consisting of Ya and Yb. $R_{21}$ represents one selected from the group consisting of the following (a) to (c):

(a) a hydrogen atom;

(b) a hydrocarbon group having 1 to 30 carbon atoms; and (c) a structure including a portion bonding to a resin through a bond selected from the group consisting of an ether bond, an ester bond and a urethane bond.

$Z_2$ represents one selected from the group consisting of a hydrogen atom and a hydrocarbon group having 1 to 30 carbon atoms.

Formula (10)

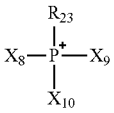

In Formula (10), $X_8$ to $X_{10}$ each represent a structure including a portion bonding to a resin through a bond selected from the group consisting of an ether bond, an ester bond and a urethane bond. $R_{23}$ represents one selected from the group consisting of the following (a) to (c):

(a) a hydrogen atom;

(b) a hydrocarbon group having 1 to 30 carbon atoms; and (c) a structure including a portion bonding to a resin through a bond selected from the group consisting of an ether bond, an ester bond, and a urethane bond.

Formula (11)

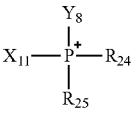

In Formula (11), $X_{11}$ represents a structure including a portion bonding to a resin through a bond selected from the group consisting of an ether bond, an ester bond and a urethane bond. $Y_8$ represents one selected from the group consisting of Ya and Yb in Formulas (14) and (15). $R_{24}$ and $R_{25}$ each independently represent one selected from the group consisting of the following (a) to (c):

(a) a hydrogen atom;

(b) a hydrocarbon group having 1 to 30 carbon atoms; and (c) a structure including a portion bonding to a resin through a bond selected from the group consisting of an ether bond, an ester bond and a urethane bond.

Formula (12)

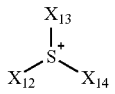

In Formula (12), $X_{12}$ to $X_{14}$ each independently represent a structure including a portion bonding to a resin through a bond selected from the group consisting of an ether bond, an ester bond and a urethane bond.

Formula (13)

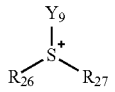

In Formula (13), $Y_9$ represents one selected from the group consisting of Ya and Yb in Formulas (14) and (15). $R_{26}$ and $R_{27}$ each independently represent one selected from the group consisting of the following (a) to (c), provided that at least one of $R_{26}$ and $R_{27}$ is (c):

(a) a hydrogen atom;

(b) a hydrocarbon group having 1 to 30 carbon atoms; and (c) a structure including a portion bonding to a resin through a bond selected from the group consisting of an ether bond, an ester bond and a urethane bond.

In Formulas (14) and (15), $A_1$ and $A_2$ each represent a hydrocarbon group or an alkylene ether group, as described above. $A_1$ and $A_2$ each independently have a shortest length of 9 atoms or less. In the case of $A_1$ and $A_2$ representing a hydrocarbon group, for example, a nonylene group meets the requirement. In the case of $A_1$ and $A_2$ representing an alkylene ether group, a polytetramethylene glycol group with a degree of polymerization of 2, or a polyethylene glycol group with a degree of polymerization of 3 meets the requirement. $A_1$ and $A_2$ may include another functional group having no hydroxyl group (e.g. a hydrocarbon group having 1 to 30 carbon atoms, a halogen group such as fluorine, chlorine, bromine and iodine, an alkoxy group such as a methoxy group and an ethoxy group, a substituent including a hetero atom such as an amide group and a cyano group, and a haloalkyl group such as trifluoromethyl group).

The electro-conductive layer may include a cationic structure represented by, for example, at least one selected from the group consisting of the following Formulas (16) to (18).

Formula (16)

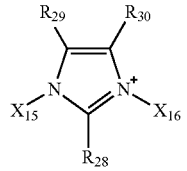

In Formula (16), $X_{15}$ and $X_{16}$ each independently represent a structure including a portion bonding to a resin through a bond selected from the group consisting of an ether bond, an ester bond and a urethane bond. $R_{28}$ to $R_{30}$ each independently represent one selected from the group consisting of the following (a) to (c), provided that at least one of $R_{28}$ to $R_{30}$ is (C):

(a) a hydrogen atom;

(b) a hydrocarbon group having 1 to 30 carbon atoms; and (c) a structure including a portion bonding to a resin through a bond selected from the group consisting of an ether bond, an ester bond and a urethane bond.

Formula (17)

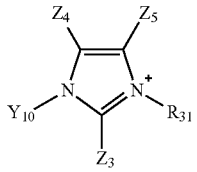

In Formula (17), $Y_{10}$ represents one selected from the group consisting of Ya and Yb in Formulas (14) and (15). $Z_3$, $Z_4$ and $Z_5$ each independently represent a hydrogen atom or a hydrocarbon group having 1 to 30 carbon atoms. $R_{31}$ represents a structure including a portion bonding to a resin through a bond selected from the group consisting of an ether bond, an ester bond, and a urethane bond, or one selected from the group consisting of Ya and Yb in Formulas (14) and (15).

Formula (14)

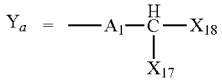

Formula (15)

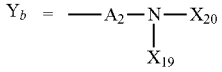

In Formulas (14) and (15), $A_1$ and $A_2$ each independently represent a hydrocarbon group or an alkylene ether group. $X_{17}$ to $X_{20}$ each independently represent a structure including a portion bonding to a resin through a bond selected from the group consisting of an ether bond, an ester bond and a urethane bond.

Formula (18)

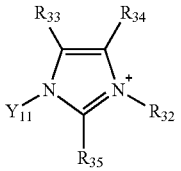

In Formula (18), $Y_{11}$ represents one selected from the group consisting of Ya and Yb in Formulas (14) and (15). $R_{32}$ represents one selected from the group consisting of the following (a) to (c), or one selected from the group consisting of Ya and Yb in Formulas (14) and (15):

(a) a hydrogen atom;

(b) a hydrocarbon group having 1 to 30 carbon atoms; and (c) a structure including a portion bonding to a resin through a bond selected from the group consisting of an ether bond, an ester bond and a urethane bond.

$R_{33}$ to $R_{35}$ each independently represent one selected from the group consisting of the (a) to (c), provided that at least one of $R_{33}$ to $R_{35}$ is (c).

In the following, the term "deformation recovery" means the properties of an electro-conductive layer to recover deformation after the passage of a predetermined period after removal of the stress applied to the electro-conductive layer left standing in a high temperature and high humidity environment for a long period under stressed state (i.e. in a state that the electro-conductive layer is deformed).

As the deformation recovery of the electro-conductive layer increases, the amount of residual deformation is reduced when an electrophotographic member having the electro-conductive layer is left standing in a high temperature and high humidity environment for a long period.

The present inventors presume the reason that use of the cation and the anion of the present invention has remarkable effects on the improvement in the deformation recovery of an electro-conductive layer is as follows.

First of all, the resin contained in an electro-conductive layer including a polar functional group such as a carboxy group, a urethane group, an ester group, a hydroxyl group and an amino group allows the polar functional groups to mutually form pseudo cross-linking points due to interaction such as hydrogen bonding. It is presumed that the pseudo cross-linking points become the basis for keeping the deformation recovery.

It is presumed, however, that use of an ion conducting agent in a resin causes reduction in the deformation recovery in some cases, due to the interaction between the ion conducting agent and the polar functional group, which reduces the interaction between polar functional groups as basis of the pseudo cross-linking points.

Hereinafter, occurrence mechanisms of the effects of the present invention corresponding to the difference in the kind of cations and anions are sequentially described.

In a resin synthesized from an ion conducting agent having two hydroxyl groups in a cation and a compound being able to react with the ion conducting agent, the cationic structure contained in the resin bonds to a polymer chain at two sites so as to be integrated into the main chain of a polymer. Although the free motion frequency of the cationic structure integrated into a main chain is limited to an extent, the movability can be kept to an extent due to the bonds to a polymer chain at only two sites.

When the cationic structure in this state approaches a polar functional group (e.g. a carboxy group, a urethane group, an ester group, a hydroxyl group and an amino group) in the resin, the negatively polarized portion of the polar functional group and the cationic structure having a positive charge are attracted to each other. As a result, it is presumed that the interaction between the polar functional groups decreases, so that the number of the pseudo cross-linking points decreases, causing difficulty in keeping the deformation recovery.

In contrast, in a resin synthesized from an ion conducting agent having three or more hydroxyl groups in a cation and a compound being able to react with the ion conducting agent as in the present invention, the cationic structure contained in the resin bonds to a polymer chain at three or more sites. The free motion frequency of the cationic structure is, therefore, further limited in comparison with the preceding case, causing difficulty for the cationic structure in approaching the polar functional group in the resin. In addition, the bulky cationic structure obstructs the movement of the cationic structure, causing difficulty for the cationic structure in approaching the polar functional group.

As a result, the cationic structure and the polar functional group cannot be attracted to each other, different from the preceding case. Accordingly, it is presumed that reduction in the deformation recovery can be suppressed to a small extent, with substantially no reduction in the interaction between the polar functional groups (pseudo cross-linking points).

In addition, it is presumed that the kind of anions can be a cause of obstructing the interaction between the polar functional groups.

It is presumed that an anion to easily reduce a proton, having a high proton affinity, such as a halide anion, a sulfate anion and a nitrate anion, easily causes an interaction between the anion and the proton which the polar functional group has.

In other words, it is presumed that the proton which a polar functional group has (e.g. the proton located at the a position relative to the carbonyl group in an ester group, and the proton which a urethane group, an amino group or a hydroxyl group has) is positively charged due to polarization, causing interaction with a negatively polarized portion of the polar functional group.

It is therefore presumed that use of an anion having a high proton affinity cannot suppress reduction in the deformation recovery resulting from the loss of interaction between polar functional groups (pseudo cross-linking points) due to the interaction between the anion and the proton.

In contrast, the anions of the present invention have extremely high chemical stability and low proton affinity, hence the anions hardly reduce the proton.

It is presumed that the interaction between the anion and the proton of the polar functional group is therefore hardly caused, so that almost no interaction between the polar functional groups (pseudo cross-linking points) is lost, thereby enabling the deformation recovery to be kept.

As described above, both of the cation and the anion of the present invention are the ones not reducing the interaction between the polar functional groups of the resin of an electro-conductive layer. It is presumed that use of the ion conducting agent of the present invention therefore can suppress reduction in the deformation recovery of the electro-conductive layer.

As shown in Examples and Comparative Examples, with only either one of the cation and the anion being identical to that of the present invention, no effect on reduction in the amount of deformation of an electrophotographic member (no effect on maintaining the deformation recovery of an electro-conductive layer) is obtained.

It is therefore presumed that the effects of the present invention result from the synergy effect of the effects of cations and the effects of anions as described above.

The electrophotographic member of the present invention can be used in an electrophotographic member such as a charging roller, a developing roller, a transferring roller, a cleaning blade.

In use of the electrophotographic member of the present invention in the developing roller of the developing apparatus, the developer may be of a magnetic type or a non-magnetic type, and may include one component or two components. The developing apparatus may be of a non-contact type or a contact type.

<Process Crtridge and Eectrophotographic Aparatus>

Figure 2:
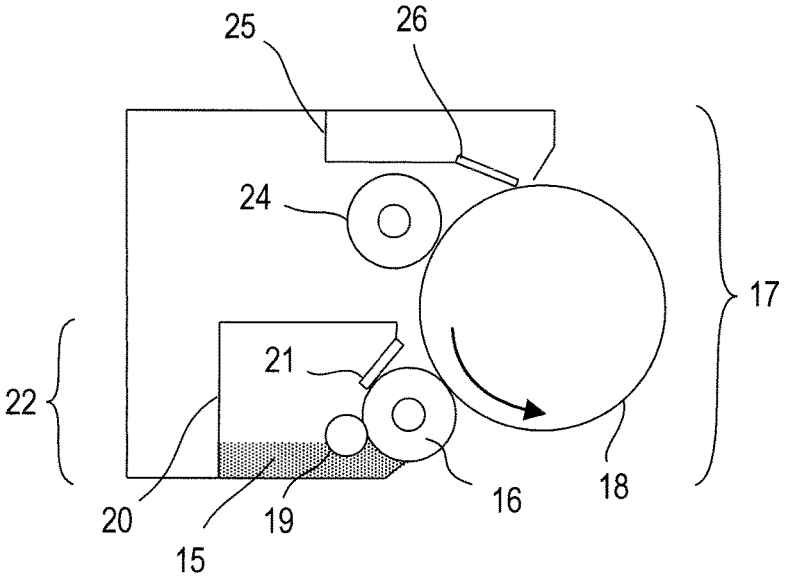
FIG. 2 is a schematic view illustrating an example of the process cartridge of the present invention.

FIG. 2 is a cross-sectional view illustrating the process cartridge of the present invention. The process cartridge 17 illustrated in FIG. 2 includes a developing roller 16, a developing blade (toner amount regulating blade) 21, electrophotographic photosensitive member 18, a cleaning blade 26, a waste toner accommodation container 25, and a charging roller 24, which are integrated. The process cartridge is adapted to be detachably attached to the main body of an electrophotographic image forming apparatus. The developing apparatus 22 includes a toner container 20 filled with a toner 15. The toner 15 contained in the toner container 20 is supplied to the surface of the developing roller 16 with a toner supply roller 19, and a toner layer having a predetermined thickness is formed on the surface of the developing roller 16 with the developing blade 21.

Figure 3:
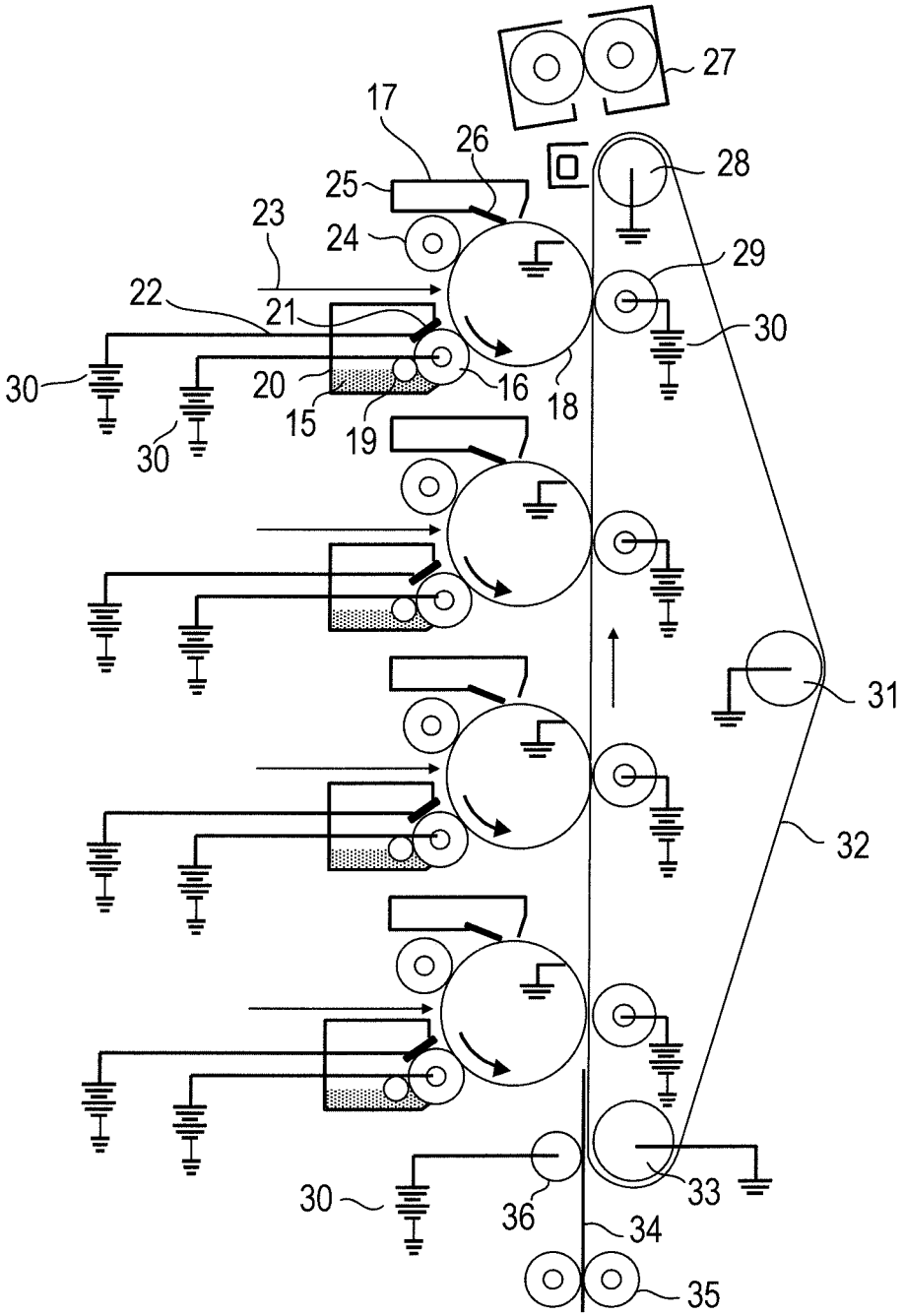
FIG. 3 is a schematic view illustrating an example of the electrophotographic apparatus of the present invention.

FIG. 3 is a cross-sectional view illustrating an electrophotographic apparatus in which the electrophotographic member of the present invention is used as developing roller 16. A developing apparatus 22 including the developing roller 16, a toner supply roller 19, a toner container 20 in which a toner 15 can be accommodated and a developing blade 21 is detachably mounted to the electrophotographic apparatus in FIG. 3. A process cartridge 17 including a photosensitive member 18, a cleaning blade 26, a waste toner accommodation container 25 and a charging roller 24 is also detachably mounted. The developing apparatus 22 may be detachably mounted as a stand-alone unit, or may be integrally formed together with the process cartridge 17 so as to be detachably mounted in one united body. Alternatively, the developing apparatus 22, the photosensitive member 18, the cleaning blade 26, the waste toner accommodation container 25 and the charging roller 24 may be disposed in the electrophotographic apparatus main body. In other words, the process cartridge of the present invention may be of any type, as long as the process cartridge has at least one of the charging roller 24 and the developing roller 16, being detachably mounted to an electrophotographic apparatus main body.

The photosensitive member 18 rotates in the arrow direction so as to be uniformly charged with the charging roller 24 for charging the photosensitive member 18. An electrostatic latent image is then formed on the surface of the photosensitive member 18 with a laser beam 23 from an exposure unit for forming an electrostatic latent image on the photosensitive member 18. The electrostatic latent image is developed with the toner 15 imparted with the developing apparatus 22 disposed in contact with the photosensitive member 18, so as to be visualized as a toner image.

In development, a so-called reversal development to form a toner image on an exposed portion is performed. The visualized toner image on the photosensitive member 18 is transferred to a paper 34 as recording medium with a transferring roller 29 as transferring member. The paper 34 is fed into the apparatus through a paper feed roller 35 and an adsorption roller 36, and transported between the photosensitive member 18 and the transferring roller 29 with a transfer transporting belt 32 in an endless belt form. The transfer transporting belt 32 is operated with a driven roller 33, a driving roller 28 and a tension roller 31. A voltage is applied to the transfer roller 29 and the adsorption roller 36 from a bias power supply 30. The paper 34 with the transferred toner image is subjected to fixation treatment with a fixation apparatus 27, and ejected outside the apparatus for completion of the printing operation.

On the other hand, the toner remaining on the photosensitive member 18 without being transferred to the paper 34 is scraped off with a cleaning blade 26 so as to be accommodated in the waste toner accommodation container 25.

The developing apparatus 22 includes a toner container 20 which accommodates toner as one-component developer, and a developing roller 16 as developer carrier which is positioned at an opening extending in the longitudinal direction of the toner container 20 and disposed opposite to the photosensitive member 18. The developing apparatus 22 develops an electrostatic latent image on the photosensitive member 18 and visualizes the image. A voltage is applied to each of the developing roller 16 and the developing blade 21 from the bias power supply 30.

Specific Examples using the electro-conductive layer of the pEesent iRvention in the surface layer 4 of a conductive roller 1 as illustrated in FIG. 1B and Comparative Examples are described in the following, though the present invention is not limited to the Examples.

(Preparation of Elastic Roller D-1)

A core metal made of SUS 304 having a diameter of 6 mm, a total length of 278.9 mm was coated with a primer (trade name: DY35-051; manufactured by Dow Corning Toray Co., Ltd.), and baked in an oven heated at a temperature of 180° C. for 20 minutes so as to make a mandrel.

The mandrel thus prepared was disposed in a mold, and an addition type silicone rubber composition including a mixture of the following materials was injected into a cavity formed in the mold.

Liquid silicon rubber material (trade name: SE6724A/B; manufactured by Dow Corning Toray Co., Ltd.): 100 parts by mass;

Carbon black (trade name: TOKA BLACK #4300; manufactured by Tokai Carbon Co., Ltd.): 15 parts by mass;

Silica powder as heat resistance imparting agent: 0.2 parts by mass; and

Platinum Catalyst: 0.1 parts by mass.

Subsequently the mold was heated at 150° C. for 15 minutes, so that the silicone rubber was vulcanized and cured. The mandrel with the cured silicone rubber layer formed on the circumferential surface was removed from the mold, and then further heated at 180° C. for 1 hour, so that the curing reaction of the silicone rubber layer was completed. An elastic roller D-1 having a silicone rubber elastic layer with a diameter of 12 mm formed on the outer circumference of the mandrel was thus prepared.

(Preparation of Elastic Roller D-2)

A round bar made of free-cutting steel having a total length of 252 mm and an outer diameter of 6 mm, with an electroless nickel-plated surface, was prepared. Subsequently the whole circumference of the round bar in the 230-mm range excluding 11-mm ranges at both ends, respectively, was coated with an adhesive so as to make a mandrel. The adhesive for use was of a conductive hot-melt type. A roll coater was used for the coating.

Subsequently the materials with a type and an amount specified in the following were mixed with a pressure kneader so as to obtain an A kneaded rubber composition.

NBR rubber (trade name: NIPOL DN219; manufactured by Zeon Corporation): 100.0 parts by mass;

Carbon black (trade name: TOKA BLACK #4300; manufactured by Tokai Carbon Co., Ltd.): 40.0 parts by mass;

Calcium carbonate (trade name: NANOX #30; manufactured by Maruo Calcium Co., Ltd.): 20.0 parts by mass; and Stearic acid (trade name: STEARIC ACID S; manufactured by Kao Corporation): 1.0 part by mass.

Further, 166.0 parts by mass of the A kneaded rubber composition and the materials with a type and an amount specified in the following were mixed with an open roll so as to prepare an unvulcanized rubber composition.

Sulfur (trade name: SULFAX 200S; manufactured by Tsurumi Chemical Industry Co., Ltd.): 1.2 parts by mass; and Tetrabenzylthiuram disulfide (trade name: TBZTD; manufactured by Sanshin Chemical Industry Co., Ltd.): 4.5 parts by mass.

Subsequently a die having an inner diameter of 16.5 mm was mounted to a cross head extruder having a mandrel supply mechanism and an unvulcanized rubber roller discharge mechanism. The temperature of the extruder and the die (cross head) was then adjusted to 80° C., and the transportation speed of the conductive mandrel was adjusted to 60 mm/sec. The unvulcanized rubber composition was supplied from the extruder under the conditions, so that the conductive mandrel was coated with the unvulcanized rubber composition to make an elastic layer in the cross head. Subsequently the coated mandrel was fed in a hot air vulcanization furnace at 170° C. and heated for 60 minutes. After cooling, the edge of the elastic layer was cut off for removal, and the surface of the elastic layer was ground with a rotary grindstone. Consequently an elastic roller D-2 having a diameter of 8.4 mm at each of the positions 90 mm away from the central part toward each end in the axial direction and a diameter of 8.5 mm at the central part was prepared.

(Formation of Surface Layer)

Synthesis examples of the ion conducting agent for obtaining the surface layer of the present invention are described in the following. The nucleophiles, the electrophiles and the anion exchange salts for use are described in Table 1, Table 2 and Table 3, respectively. The amounts of the nucleophiles, the electrophiles and the anion exchange salts blended are described in Table 4.

<Synthesis of Ion Conducting Agent>

An ion conducting agent can be obtained by synthesizing a precursor using a one-step or a plurality of steps of a known nucleophilic substitution reaction such as Menschutkin reaction and then performing a known ion exchange reaction.

Accordingly, examples of the nucleophile for use include a compound having a nucleophilic hetero atom such as primary to tertiary amine compounds, an imidazole compound, a pyridine compound, a piperidine compound, a pyrrolidine compound, a morpholine compound, a pyrazole compound, a sulfide compound and a phosphine compound.

Further, examples of the electrophile for use include a halogenated alkyl compound of which hydroxyl group is substituted.

Further, examples of the alkali metal salt for use in the ion exchange reaction include an alkali metal salt which contains the anion of the present invention such as a lithium fluorinated alkyl sulfonate salt and a potassium fluorinated alkylsulfonylimide salt.

A target ion conducting agent can be synthesized with a combination of known methods, by changing the nucleophile and the electrophile for use in a nucleophilic reaction, and the alkali metal salt for use in an ion exchange reaction into a desired combination.

Examples of the synthesis of an ion conducting agent are described in the following.

(Synthesis of Ion Conducting Agent 1-3)

A nucleophile N-1 (dibutylamine) (manufactured by Tokyo Chemical Industry Co., Ltd.) in an amount of 24.2 g was dissolved in 50 ml of acetonitrile. An electrophile Q-(4-bromo-1-butanol) (manufactured by Tokyo Chemical Industry Co., Ltd.) in amount of 68.3 g was added to the solution at room temperature, which was then heated and refluxed at 90° C. for 72 hours. Subsequently the solvent was distilled away under reduced pressure. The obtained concentrate was washed with diethyl ether, and the supernatant liquid was removed by decantation. The washing and the decantation was repeated three times, so that a residue was obtained. The obtained residue is a compound having a bromide ion.

In order to exchange the bromide ion with a target anion, the obtained residue was dissolved in 30 ml of dichloromethane. An anion exchange salt A-2 (lithium bis(trifluoromethanesulfonyl)imide) (manufactured by Kanto Chemical Co., Inc.) in an amount of 57.5 g dissolved in 30 ml of water was added to the solution, which was then stirred at room temperature for 24 hours. The obtained solution was separated, so that an organic layer was obtained. The organic layer was separated with water two times, and dichloromethane was distilled away under reduced pressure. Consequently an ion conducting agent 1-3 was obtained, having bis(trifluoromethanesulfonyl)imide anion as the anion.

TABLE 1

| Nucleophile | |
|---|---|
| Dibutylamine (manufactured by Tokyo Chemical Industry Co., Ltd.) | N-1 |
| Triethanolamine (manufactured by Tokyo Chemical Industry Co., Ltd.) | N-2 |
| 4-Butylamino-1-butanol (manufactured by Tokyo Chemical Industry Co., Ltd.) | N-3 |
| 2-Aminoethanol (manufactured by Tokyo Chemical Industry Co., Ltd.) | N-4 |
| 3-Methylamino-1-propanol (manufactured by Tokyo Chemical Industry Co., Ltd.) | N-5 |
| NEWPOL NP-400 NP-400 (manufactured by Sanyo Chemical Industries, Ltd.) | N-6 |
| 4-Amino-1-butanol (manufactured by Tokyo Chemical Industry Co., Ltd.) | N-7 |
| Butylamine (manufactured by Tokyo | N-8 |

TABLE 1-continued

| Nucleophile | |
|---|---|
| Chemical Industry Co., Ltd.) | |
| 3-Amino-1,2-propanediol (manufactured by Tokyo Chemical Industry Co., Ltd.) | N-9 |
| 1-(2-Hydroxyethyl)imidazole (manufactured by Sigma-Aldrich Co. LLC.) | N-10 |
| (1H-Imidazol-2-yl)methanol (manufactured by Sigma-Aldrich Co. LLC.) | N-11 |
| 4-Hydroxymethylimidazole (manufactured by Sigma-Aldrich Co. LLC.) | N-12 |
| Imidazole (manufactured by Tokyo Chemical Industry Co., Ltd.) | N-13 |
| 4-Pyridineethanol hydrochloride (manufactured by Tokyo Chemical Industry Co., Ltd.) | N-14 |
| 2-Pyridineethanol (manufactured by Tokyo Chemical Industry Co., Ltd.) | N-15 |
| 2-Pyrrolidin-2-yl-ethanol (manufactured by Sigma-Aldrich Co. LLC.) | N-16 |
| 1-Piperidine ethanol (manufactured by Tokyo Chemical Industry Co., Ltd.) | N-17 |
| 4-Piperidine ethanol (manufactured by Tokyo Chemical Industry Co., Ltd.) | N-18 |
| Morpholine (manufactured by Tokyo Chemical Industry Co., Ltd.) | N-19 |
| Pyrazole (manufactured by Tokyo Chemical Industry Co., Ltd.) | N-20 |
| 2-2'-Thiodiethanol (manufactured by Tokyo Chemical Industry Co., Ltd.) | N-21 |
| Tris(hydroxymethyl)phosphine (manufactured by Sigma-Aldrich Co. LLC.) | N-22 |

TABLE 2

| Electrophile | |
|---|---|
| 4-Bromo-1-butanol (manufactured by Tokyo Chemical Industry Co., Ltd.) | Q-1 |
| Methyl iodide (manufactured by Tokyo Chemical Industry Co., Ltd.) | Q-2 |
| 1-Chlorotriacontane (manufactured by Tokyo Chemical Industry Co., Ltd.) | Q-3 |
| 3-Chloro-1,2-propanediol (manufactured by Tokyo Chemical Industry Co., Ltd.) | Q-4 |
| 1-Bromodecane (manufactured by Tokyo Chemical Industry Co., Ltd.) | Q-5 |

TABLE 2-continued

| Electrophile | |
|---|---|
| 2-[2-(2-Chloroethoxy)ethoxy]ethanol (manufactured by Tokyo Chemical Industry Co., Ltd.) | Q-6 |
| Tetraethylene glycol p-toluenesulfonate (manufactured by Sigma-Aldrich Co. LLC.) | Q-7 |
| 2-Bromoethanol (manufactured by Tokyo Chemical Industry Co., Ltd.) | Q-8 |

TABLE 3

| Anion exchange salt | |
|---|---|
| Lithium trifluoromethane sulfonate (manufactured by Wako Pure Chemical Industries, Ltd.) | A-1 |
| Lithium bis(trifluoromethanesulfonyl)imide (manufactured by Kanto Chemical Co., Ltd.) | A-2 |
| Lithium perchlorate (manufactured by Kanto Chemical Co., Ltd.) | A-3 |
| Potassium bis(fluorosulfonyl)imide (manufactured by Mitsubishi Materials Electronic Chemicals Co., Ltd.) | A-4 |
| Potassium bis(nonafluorobutane sulfonyl)imide (manufactured by Mitsubishi Materials Electronic Chemicals Co., Ltd.) | A-5 |
| Sodium dicyanamide (manufactured by Tokyo Chemical Industry Co., Ltd.) | A-6 |
| Potassium tris(trifluoromethanesulfonyl)methide (trade name: K-TFSM; manufactured by Central Glass Co., Ltd.) | A-7 |
| Potassium heptafluoropropanesulfonate (trade name: EF-32; manufactured by Mitsubishi Materials Electronic Chemicals Co., Ltd.) | A-8 |
| Lithium trifluoroacetate (manufactured by Wako Pure Chemical Industries, Ltd.) | A-9 |
| Potassium cyclo-hexafluoropropane-1,3-bis(sulfonyl)imide (trade name: EF-X302: manufactured by Mitsubishi Materials Electronic Chemicals Co., Ltd.) | A-10 |
| Potassium trifluoro(trifluoromethyl)borate (manufactured by Tokyo Chemical Industry Co., Ltd.) | A-11 |
| Lithium hexafluorophosphate (manufactured by Wako Pure Chemical Industries, Ltd.) | A-12 |
| Lithium hexafluoroantimonate (manufactured by Wako Pure Chemical Industries, Ltd.) | A-13 |
| Lithium hexafluoroarsenate (manufactured by Tokyo Chemical Industry Co., Ltd.) | A-14 |
| Lithium bis(oxalato)borate (trade name: LiBOB; manufactured by BOC Sciences Co.) | A-15 |

TABLE 4

| Ion con-ducting agent | Nucleo-phile | Nucleo-phile (g) | Electro-phile | Electro-phile (g) | Anion exchange salt | Anion exchange salt (g) |
|---|---|---|---|---|---|---|
| 1-3 | N-1 | 24.2 | Q-1 | 68.3 | A-2 | 57.5 |
| 1-4 | N-2 | 46.0 | Q-2 | 65.8 | A-3 | 36.0 |
| 1-5 | N-2 | 33.0 | Q-2 | 47.1 | A-2 | 69.9 |
| 1-7 | N-4 | 9.2 | Q-1 | 104.2 | A-4 | 36.5 |
| 1-9 | N-6 | 44.4 | Q-5 | 34.6 | A-5 | 71.1 |
| 2-2 | N-10 | 27.0 | Q-8 | 45.2 | A-2 | 76.1 |
| 2-3 | N-12 | 17.6 | Q-8 | 67.2 | — | — |
| 2-4 | N-12 | 17.6 | Q-8 | 67.2 | A-10 | 65.2 |
| 2-6 | N-13 | 17.8 | Q-4 | 87.7 | A-12 | 44.4 |
| 2-7 | N-11 | 21.1 | Q-4 | 71.2 | A-13 | 57.7 |

TABLE 4-continued

| Ion conducting agent | Nucleophile | Nucleophile (g) | Electrophile | Electrophile (g) | Anion exchange salt | Anion exchange salt (g) |
|---|---|---|---|---|---|---|
| 3-1 | N-14 | 30.6 | Q-4 | 41.0 | A-2 | 78.4 |
| 3-2 | N-15 | 40.1 | Q-4 | 53.8 | A-1 | 56.0 |
| 4-1 | N-16 | 23.6 | Q-8 | 77.0 | A-4 | 49.4 |
| 4-2 | N-16 | 31.7 | Q-4 | 91.1 | A-6 | 27.0 |
| 5-1 | N-17 | 24.5 | Q-4 | 31.4 | A-7 | 94.1 |
| 5-2 | N-18 | 32.7 | Q-4 | 83.8 | A-9 | 33.5 |
| 8-1 | N-21 | 39.0 | Q-4 | 55.0 | A-12 | 55.7 |
| 8-2 | N-21 | 30.7 | Q-8 | 49.2 | A-13 | 70.1 |
| 9-2 | N-22 | 25.0 | Q-4 | 54.3 | A-15 | 70.2 |

(Synthesis of Ion Conducting Agents 1-4, 1-5, 1-7, 1-9, 2-2 to 2-4, 2-6, 2-7, 3-1, 3-2, 4-1, 4-2, 5-1, 5-2, 8-1, 8-2 and 9-2)

Ion conducting agents 1-4, 1-5, 1-7, 1-9, 2-2 to 2-4, 2-6, 2-7, 3-1, 3-2, 4-1, 4-2, 5-1, 5-2, 8-1, 8-2 and 9-2 were obtained in the same way as in the synthesis of the ion conducting agent 1-3, except that the types and the amounts of the nucleophile, the electrophile and the anion exchange salt as raw materials blended were changed as described in Tables 1 to 4. An ion conducting agents 2-3 was obtained as a chloride salt without anion exchange.

(Synthesis of Ion Conducting Agent 1-6)

A nucleophile N-3 (4-butylamino-1-butanol) (manufactured by Tokyo Chemical Industry Co., Ltd.) in an amount of 18.7 g was dissolved in 200 ml of benzene (manufactured by Kanto Chemical Co., Inc.). An electrophile Q-3 (1-chlorotriacontane) (manufactured by Tokyo Chemical Industry Co., Ltd.) for tertiarization in amount of 88.0 g dissolved in 200 ml of benzene was dropwisely added into the solution, which was then heated and refluxed at 85° C. for 42 hours. After completion of the reaction, 800 ml of 5 mass % aqueous solution of sodium carbonate was added for extraction. A benzene layer was washed with water and dried. Benzene was then distilled away, so that a tertiary amine compound was obtained as a yellow viscous liquid. Subsequently the obtained tertiary amine compound was dissolved in 300 ml of acetonitrile. An electrophile Q-4 (3-chloro-1,2-propanediol) (manufactured by Tokyo Chemical Industry Co., Ltd.) for quaternization in an amount of 21.2 g was added to the solution at room temperature, which was then heated and refluxed at 90° C. for hours. The solvent was then distilled away under reduced pressure. The obtained concentrate was washed with diethyl ether, and the supernatant liquid was removed by decantation. The procedure was repeated three times, so that a residue was obtained. The obtained residue is a compound having a chloride ion.

In order to exchange the chloride ion with a target anion, the obtained residue was dissolved in 20 ml of dichloromethane. An anion exchange salt A-1 (lithium trifluoromethanesulfonate) (manufactured by Wako Pure Chemical Industries, Ltd.) in an amount of 22.1 g dissolved in 20 ml of water was added to the solution, which was stirred at room temperature for 24 hours. The obtained solution was separated to obtain an organic layer. The organic layer was separated with water two times. Dichloromethane was distilled away under reduced pressure, so that an ion conducting agent 1-6 was obtained, having trifluoromethane sulfonate anion as the anion.

TABLE 5

| Ion conducting agent | Nucleophile | Amount added (g) | Electrophile for tertialization | Amount added (g) | Electrophile for quaternization | Amount added (g) | Anion exchange salt | Amount added (g) |
|---|---|---|---|---|---|---|---|---|
| 1-6 | N-3 | 18.7 | Q-3 | 88.0 | Q-4 | 21.2 | A-1 | 22.1 |
| 1-10 | N-7 | 17.9 | Q-4 | 66.3 | Q-1 | 46.1 | A-6 | 19.7 |
| 1-11 | N-8 | 5.9 | Q-7 | 83.9 | Q-6 | 20.4 | A-7 | 39.8 |
| 2-5 | N-12 | 21.0 | Q-4 | 35.4 | Q-8 | 40.2 | A-11 | 53.3 |
| 6-1 | N-19 | 16.2 | Q-4 | 30.8 | Q-8 | 35.0 | A-10 | 68.0 |
| 7-1 | N-20 | 15.0 | Q-4 | 37.0 | Q-8 | 42.1 | A-11 | 55.8 |

(Synthesis of Ion Conducting Agents 1-10, 1-11, 2-5, 6-1 and 7-1)

Ion conducting agents 1-10, 1-11, 2-5, 6-1 and 7-1 were obtained by the same way as in the synthesis of the ion conducting agent 1-6, except that the type and the amounts of the nucleophile, the electrophile, and the anion exchange salt as raw materials blended were changed as described in Table 5.

(Synthesis of Ion Conducting Agent 1-8)

Potassium carbonate in an amount of 14.8 g was added to 100 mL of acetonitrile solution of 15.4 g of a nucleophile N-5 (3-methylamino-1-propanol) (manufactured by Tokyo Chemical Industry Co., Ltd.) and 16.1 g of 4-chloromethyl-2,2-dimethyl-1,3-dioxolane. The solution was then heated and refluxed at 90° C. for 18 hours. After completion of the reaction, the solution was cooled to room temperature, and the precipitated solid was filtered and washed with 300 mL of acetonitrile. The filtrate was concentrated under reduced pressure and then purified with silica gel column chromatography, so that 5.7 g of an intermediate 1 was obtained.

A nucleophile Q-4 (3-chloro-1,2-propanediol) (manufactured by Tokyo Chemical Industry Co., Ltd.) in an amount of 2.1 mL was added to 5.0 g of the intermediate 1 for a reaction at 100° C. for 96 hours. After completion of the reaction, the product was cooled to room temperature and diluted with 5 mL of methanol. Subsequently 10 mL of 1 mol/L hydrochloric acid aqueous solution was added to the diluted product, and the mixture was then stirred at room temperature for 24 hours. After the solvent was distilled away under reduced pressure, 24 mL of water was added and 24 mL of an aqueous solution of 6.9 g of an anion exchange salt A-2 (lithium bis(trifluoromethanesulfonyl)imide) (manufactured by Kanto Chemical Co., Inc.) was dropwisely added thereto. After the solution was stirred for 1 hour and dried under reduced pressure, 14.1 g of an ion conducting agent 1-8 was obtained.

(Synthesis of Ion Conducting Agent 1-12)

A nucleophile N-9 (3-amino-1,2-propanediol) (manufactured by Tokyo Chemical Industry Co., Ltd.) in an amount of 2.02 g was dissolved in 20 ml of benzene (manufactured by Kanto Chemical Co., Inc.). An electrophile Q-7 (tetraethylene glycol p-toluenesulfonate) (manufactured by Sigma-Aldrich Co. LLC.) in an amount of 11.6 g dissolved in 10 ml of benzene was dropwisely added into the solution, which was then heated and refluxed at 85° C. for 42 hours. After completion of the reaction, 80 ml of 5 mass % sodium carbonate aqueous solution was added for extraction, and the benzene layer was washed with water. After drying, benzene was distilled away, so that a secondary amine compound was obtained as a yellow viscous liquid. Subsequently, while stirring the secondary amine compound in a reaction vessel having a stirring apparatus, a thermometer, a reflux tube, a dropping apparatus and a temperature control apparatus, 100 parts by mass of pure water was added thereto, and the mixture was heated to 40° C. Subsequently 29.3 g of ethylene oxide was gradually and dropwisely added thereto in 30 minutes, while the reaction temperature was maintained at 40° C. or lower. The reaction was performed with stirring for further 2 hours, so that a reaction mixture was obtained. The obtained reaction mixture was diluted with addition of diethyl ether. An ammonium chloride aqueous solution was added to the diluted product for extraction, so that a tertiary ammonium chloride was obtained.

In order to exchange the chloride ion of the tertiary ammonium chloride with a target anion, the obtained tertiary ammonium chloride was dissolved in 5 ml of dichloromethane. An anion exchange salt A-8 (potassium heptafluoropropane sulfonate (manufactured by Mitsubishi Materials Electronic Chemicals Co., Ltd.) in amount of 7.04 g dissolved in 5 ml of water was then added to the solution, which was then stirred at room temperature for 24 hours. The produced solution was separated to obtain an organic layer. The organic layer was separated with water two times, and then dichloromethane was distilled away under reduced pressure. An ion conducting agent 1-12 was thus obtained, having a heptafluoropropane sulfonate anion as the anion.

(Synthesis of Ion Conducting Agent 1-13)

While stirring 1.56 g of a nucleophile N-7 (4-amino-1-butanol) (manufactured by Tokyo Chemical Industry Co., Ltd.) in a reaction vessel having an stirring apparatus, a thermometer, a reflux tube, a dropping apparatus and a temperature control apparatus, 100 parts by mass of pure water added thereto, and the mixture was heated to 40° C. Subsequently 46.1 g of ethylene oxide was gradually and dropwisely added thereto in 30 minutes, while the reaction temperature was maintained at 40° C. or lower. The reaction was performed with stirring for further 2 hours, and a reaction product was dried under reduced pressure. A quaternary ammonium hydroxide was thus obtained.

In order to exchange a hydroxide ion with a target anion, a quaternary ammonium hydroxide was dissolved in 5 ml of dichloromethane. An anion exchange salt A-9 (lithium trifluoroacetate) (manufactured by Wako Pure Chemical Industries, Ltd.) in amount of 2.31 g dissolved in 5 ml of water was then added to the solution, which was then stirred at room temperature for 24 hours. The obtained solution was separated to obtain an organic layer. The organic layer was separated with water two times, and dichloromethane was distilled away under reduced pressure. An ion conducting agent 1-13 was obtained, having a trifluoroacetate anion as the anion.

(Synthesis of Ion Conducting Agent 2-8)

While stirring 2.70 g of a nucleophile N-11 (1H-imidazol-2-yl)methanol (manufactured by Sigma-Aldrich Co. LLC.) in a reaction vessel having an stirring apparatus, a thermometer, a reflux tube, a dropping apparatus and a temperature control apparatus, 100 parts by mass of pure water was added thereto, and the mixture was heated to 40° C. Subsequently 27.23 g of ethylene oxide was gradually and dropwisely added thereto in 30 minutes, while the reaction temperature was maintained at 40° C. or lower. The reaction was performed with stirring for further 2 hours, so that a reaction mixture was obtained. The reaction mixture was heated and dried under reduced pressure, so that an imidazole compound with an ether structure being added thereto was obtained.

Subsequently the obtained imidazole compound was dissolved in 20 ml of acetonitrile. An electrophile Q-7 (tetraethylene glycol p-toluenesulfonate) (manufactured by Sigma-Aldrich Co. LLC.) in amount of 14.4 g dissolved in 10 ml of acetonitrile at room temperature was added thereto. The mixture was then heated and refluxed at 90° C. for 72 hours. The solvent was then distilled away under reduced pressure. The obtained concentrate was washed with diethyl ether, and the supernatant liquid was removed by decantation. The washing and the decantation were repeated three times, so that a residue was obtained. The anion of the obtained residue is p-toluenesulfonate anion.

In order to exchange the p-toluene sulfonate ion of the residue with a target anion, the obtained residue was dissolved in 5 ml of dichloromethane. An anion exchange salt A-14 (potassium hexafluoro arsenate) (manufactured by Tokyo Chemical Industry Co., Ltd.) in an amount of 5.72 g dissolved in 5 ml of water was then added to the mixture, which was then stirred for 24 hours. The obtained solution was separated to obtain an organic layer. The organic layer was washed with water two times and dichloromethane was distilled away under reduced pressure. An ion conducting agent 2-8 was thus obtained, having a hexafluoro arsenate anion as the anion.

(Synthesis of Ion Conducting Agent 2-9)

A nucleophile N-13 (imidazole) (manufactured by Tokyo Chemical Industry Co., Ltd.) in an amount of 1.87 g was dissolved in 20 ml of acetonitrile. An N-(2-bromoethyl) phthalimide (manufactured by Tokyo Chemical Industry Co., Ltd.) in amount of 21.3 g was then added to the solution, which was then heated and refluxed at 90° C. for 72 hours. The solvent was then distilled away under reduced pressure. The obtained concentrate was washed with diethyl ether and the supernatant liquid was removed by decantation. The washing and the decantation were repeated three times, and the residue was then dissolved in 10 ml of ethanol. A hydrazine hydrate (79%) in an amount of 2.66 g was added to the solution, which was then heated and stirred at 40° C. for 4 hours. The solution was then cooled down to room temperature so as to be filtered. The solvent in the filtrate was distilled away under reduced pressure, so that a reaction product was collected.

The obtained reaction mixture was then dissolved in 20 ml of benzene (manufactured by Kanto Chemical Co., Inc.). A nucleophile Q-8 (2-bromoethanol) (manufactured by Tokyo Chemical Industry Co., Ltd.) in an amount of 20.9 g dissolved in 20 ml of benzene was dropwisely added into the solution, which was then heated and refluxed at 85° C. for 42 hours. After completion of the reaction, 100 ml of 5 mass % sodium carbonate aqueous solution was added thereto for extraction. The benzene layer was washed with water, and benzene was distilled away after drying. The obtained residue is a compound which contains a bromide ion.

In order to exchange the bromide ion with a target anion, the obtained residue was dissolved in 5 ml of dichloromethane. An aqueous solution dissolving 5.96 g of anion exchange salt A-15 (lithium bis(oxalato)borate) (trade name: LiBOB; manufactured by BOC Sciences Co.) was then added to the solution. The mixture was then stirred for 24 hours. The obtained solution was separated to obtain an organic layer. The organic layer was washed with water two times, and dichloromethane was then distilled away under reduced pressure. An ion conducting agent 2-9 was thus obtained, having a bis(oxalato)borate anion as the anion.

(Synthesis of Ion Conducting Agent 9-1)

Tetrakis(hydroxymethyl)phosphonium chloride (manufactured by Tokyo Chemical Industry Co., Ltd.) in an amount of 23.87 g was dissolved in 20 ml of dichloromethane. An anion exchange salt A-14 (potassium hexafluoro arsenate) (manufactured by Tokyo Chemical Industry Co., Ltd.) in an amount of 26.1 g dissolved in 20 ml of water was then added to the solution. The mixture was stirred for 24 hours. The obtained solution was separated to obtain an organic layer. The organic layer was washed with water two times and then dichloromethane was distilled away under reduced pressure. An ion conducting agent 9-1 was thus obtained, having a hexafluoroarsenate anion as the anion.

Commercialized products were directly used as other ion conducting agents including an ion conducting agent 1-1 (tetrabutylammonium trifluoromethanesulfonate (manufactured by Tokyo Chemical Industry Co., Ltd.)), an ion conducting agent 1-2 (choline-bis(trifluoromethanesulfonylimide) (manufactured by Kanto Chemical Co., Inc.)), and an ion conducting agent 2-1 (1-butyl-3-methylimidazolium bis(trifluoromethanesulfonyl)imide (manufactured by Tokyo Chemical Industry Co., Ltd.)).

The synthesized ion conducting agents 1-1 to 9-2 are represented by the following structural formulas (1) to (9), respectively, and the substituents and the counter anions in the structural formulas are described in Table 6.

Structure (1)

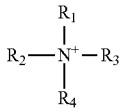

Structure (2)

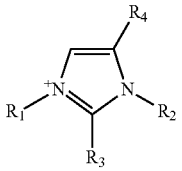

-continued

Structure (3)

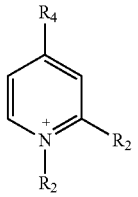

Structure (4)

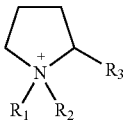

Structure (5)

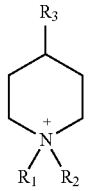

Structure (6)

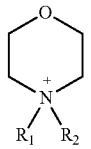

Structure (7)

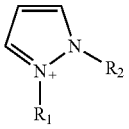

Structure (8)

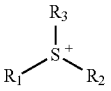

Structure (9)

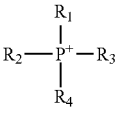

TABLE 6

| Ion conducting agent | Structure | Number of hydroxyl groups | $R_1$ | $R_2$ | $R_3$ | $R_4$ | Anion |
|---|---|---|---|---|---|---|---|
| 1-1 | (1) | 0 | $C_4H_9$ | $C_4H_9$ | $C_4H_9$ | $C_4H_9$ | $CF_3SO_3^-$ |
| 1-2 | (1) | 1 | $CH_3$ | $CH_3$ | $CH_3$ | $CH_2CH_2OH$ | $(CF_3SO_2)_2N^-$ |
| 1-3 | (1) | 2 | $C_4H_9$ | $C_4H_9$ | $(CH_2)_4OH$ | $(CH_2)_4OH$ | $(CF_3SO_2)_2N^-$ |
| 1-4 | (1) | 3 | $CH_3$ | $CH_2CH_2OH$ | $CH_2CH_2OH$ | $CH_2CH_2OH$ | $ClO_4^-$ |
| 1-5 | (1) | 3 | $CH_3$ | $CH_2CH_2OH$ | $CH_2CH_2OH$ | $CH_2CH_2OH$ | $(CF_3SO_2)_2N^-$ |
| 1-6 | (1) | 3 | $CH_2CHOHCH_2OH$ | $C_{30}H_{61}$ | $(CH_2)_4OH$ | $C_4H_9$ | $CF_3SO_3^-$ |
| 1-7 | (1) | 4 | $(CH_2)_4OH$ | $(CH_2)_4OH$ | $CH_2CH_2OH$ | $(CH_2)_4OH$ | $(FSO_2)_2N^-$ |
| 1-8 | (1) | 5 | $CH_2CHOHCH_2OH$ | $(CH_2)_3OH$ | $CH_2CHOHCH_2OH$ | $CH_3$ | $(CF_3SO_2)_2N^-$ |
| 1-9 | (1) | 5 | $(CH_2)_2N(CH_2C(CH_3)OH)_2$ | $C_{10}H_{21}$ | $(CH_2)_2N(CH_2C(CH_3)OH)_2$ | $CH_2$–$CCH_3OH$ | $(C_4F_9SO_2)_2N^-$ |
| 1-10 | (1) | 6 | $CH_2CHOHCH_2OH$ | $(CH_2)_4OH$ | $CH_2CHOHCH_2OH$ | $(CH_2)_4OH$ | $N(CN)_2^-$ |
| 1-11 | (1) | 3 | $C_4H_9$ | $(CH_2CH_2O)_2H$ | $(CH_2CH_2O)_2H$ | $(CH_2CH_2O)_2H$ | $(CF_3SO_2)_3C^-$ |
| 1-12 | (1) | 4 | $CH_2CHOHCH_2OH$ | $(CH_2CH_2O)_2H$ | $(CH_2CH_2O)_{15}H$ | H | $C_3F_7SO_3^-$ |
| 1-13 | (1) | 4 | $(CH_2)_4OH$ | $(CH_2CH_2O)_9H$ | $(CH_2CH_2O)_9H$ | $(CH_2CH_2O)_9H$ | $CF_3COO^-$ |
| 2-1 | (2) | 0 | $C_4H_9$ | $CH_3$ | H | H | $(CF_3SO_2)_2N^-$ |

TABLE 6-continued

| Ion conducting agent | Structure | Number of hydroxyl groups | $R_1$ | $R_2$ | $R_3$ | $R_4$ | Anion |
|---|---|---|---|---|---|---|---|
| 2-2 | (2) | 2 | $CH_2CH_2OH$ | $CH_2CH_2OH$ | H | H | $(CF_3SO_2)_2N^-$ |
| 2-3 | (2) | 3 | $CH_2CH_2OH$ | H | $CH_2CH_2OH$ | $CH_2OH$ | $Cl^-$ |
| 2-4 | (2) | 3 | $CH_2CH_2OH$ | H | $CH_2CH_2OH$ | $CH_2OH$ | $CF_2(CF_2SO_2)_2N^-$ |
| 2-5 | (2) | 4 | $CH_2CH_2OH$ | H | $CH_2CHOHCH_2OH$ | $CH_2OH$ | $BF_3(C_2F_5)^-$ |
| 2-6 | (2) | 4 | $CH_2CHOHCH_2OH$ | H | $CH_2CHOHCH_2OH$ | H | $PF_6^-$ |
| 2-7 | (2) | 5 | $CH_2CHOHCH_2OH$ | $CH_2CHOHCH_2OH$ | $CH_2OH$ | H | $SbF_6^-$ |
| 2-8 | (2) | 3 | $(CH_2CH_2O)_2H$ | $(CH_2CH_2O)_9H$ | $CH_2OH$ | H | $AsF_6^-$ |
| 2-9 | (2) | 4 | $(CH_2)_2N((CH_2)_2OH)_2$ | H | $(CH_2)_2N((CH_2)_2OH)_2$ | H | $(C_2O_4)_2B^-$ |
| 3-1 | (3) | 3 | $CH_2CHOHCH_2OH$ | H | — | $CH_2CH_2OH$ | $(CF_3SO_2)_2N^-$ |
| 3-2 | (3) | 3 | $CH_2CHOHCH_2OH$ | $CH_2CH_2OH$ | — | H | $CF_3SO_3^-$ |
| 4-1 | (4) | 3 | $CH_2CH_2OH$ | $CH_2CH_2OH$ | $CH_2CH_2OH$ | — | $(FSO_2)_2N^-$ |
| 4-2 | (4) | 5 | $CH_2CHOHCH_2OH$ | $CH_2CHOHCH_2OH$ | $CH_2CH_2OH$ | — | $N(CN)_2^-$ |
| 5-1 | (5) | 3 | $CH_2CHOHCH_2OH$ | $CH_2CH_2OH$ | H | — | $(CF_3SO_2)_3C^-$ |
| 5-2 | (5) | 5 | $CH_2CHOHCH_2OH$ | $CH_2CHOHCH_2OH$ | $CH_2CH_2OH$ | — | $CF_3COO^-$ |
| 6-1 | (6) | 3 | $CH_2CHOHCH_2OH$ | $CH_2CH_2OH$ | — | — | $CF_2(CF_2SO_2)_2N^-$ |
| 7-1 | (7) | 3 | $CH_2CHOHCH_2OH$ | $CH_2CH_2OH$ | — | — | $BF_3(C_2F_5)^-$ |
| 8-1 | (8) | 4 | $CH_2CH_2OH$ | $CH_2CH_2OH$ | $CH_2CHOHCH_2OH$ | — | $PF_6^-$ |
| 8-2 | (8) | 3 | $CH_2CH_2OH$ | $CH_2CH_2OH$ | $CH_2CH_2OH$ | — | $SbF_6^-$ |
| 9-1 | (9) | 4 | $CH_2OH$ | $CH_2OH$ | $CH_2OH$ | $CH_2OH$ | $AsF_6^-$ |
| 9-2 | (9) | 5 | $CH_2OH$ | $CH_2OH$ | $CH_2OH$ | $CH_2CHOHCH_2OH$ | $(C_2O_4)_2B^-$ |

(Synthesis of Isocyanate Group Terminal Prepolymer B-1)

Under nitrogen atmosphere, 100 parts by mass of poly (tetramethylene glycol-3-methyltetramethylene glycol) (trade name: PTG-L2000; manufactured by Hodogaya Chemical Co., Ltd.) was gradually and dropwisely added into 19.7 parts by mass of polymeric MDI (trade name: MILLIONATE MR200; manufactured by Tosoh Corporation (formerly Nippon Polyurethane Industries Co., Ltd.)) in a reactive vessel kept at a temperature of 65° C.

After completion of the addition, the reaction was performed at a temperature of 65° C. for 2 hours. The obtained reaction mixture was cooled down to room temperature, so that an isocyanate group terminal prepolymer B-1 with an isocyanate group content of 4.2% was obtained.

(Synthesis of Isocyanate Group Terminal Prepolymer B-2)

Under nitrogen atmosphere, 100 parts by mass of polypropylene glycol-based polyol (PPG) (trade name: SANIX PP-1000: manufactured by Sanyo Chemical Industries, Ltd.) was gradually and dropwisely added into 25 parts by mass of TDI (trade name: COSMONATE T80; manufactured by Mitsui Chemicals, Inc.) in a reactive vessel kept at a temperature of 65° C.

After completion of the addition, the reaction was performed at a temperature of 65° C. for 2 hours. The obtained reaction mixture was cooled down to room temperature, so that an isocyanate group terminal prepolymer B-2 with an isocyanate group content of 4.2% was obtained.

Example 1

The method for manufacturing the electrophotographic member of the present invention is described in the following.

The following materials were stirred and mixed as the materials for use in the electro-conductive layer as surface layer.

Reactive Compound

Reactive compound R-5 (trade name: MILLIONATE MT; manufactured by Tosoh Corporation (formerly Nippon Polyurethane Industries Co., Ltd.)): 105.9 parts by mass; and Ion Conducting Agent Ion conducting agent 1-5: 162.3 parts by mass.

Urethane resin fine particles (trade name: ART PEARL C-400, manufactured by Negami Chemical Industrial Co., Ltd.): 90.0 parts by mass.

Subsequently, methyl ethyl ketone (hereinafter referred to as MEK) was added so as to have a total solid content ratio of 30 mass % based on the total content, and then mixed with a sand mill. Further, the viscosity was adjusted to 10 to 13 cps with MEK, so that a coating material for forming a surface layer was prepared.

An elastic roller D-1 prepared in advance was immersed in the coating material for forming the surface layer so as to form a coating film of the coating material on the surface of the elastic layer of the elastic roller D-1. The elastic layer was then dried, and subsequently heat-treated at a temperature of 160° C. for 1 hour, so that a surface layer having a film thickness of 15 μm was formed on the outer circumference of the elastic layer. The electrophotographic member in Example 1 was thus prepared.

The cationic structure in the surface layer contained in the branched portion of the polymer chain of resin and the electro-conductive layer having at least one structure selected from the group consisting of Formulas (1) to (13) can be confirmed, for example, by analysis such as thermal decomposition GC/MS, emission gas analysis (EGA-MS), FT-IR, and NMR.

The surface layer obtained in the present Examples was analyzed with a thermal decomposition apparatus (trade name: PYRO WHEEL SAMPLER JPS-700, manufactured by Japan Analytical Industry Co., Ltd.) and a GC/MS apparatus (trade name: FOCUS GC/ISQ, manufactured by Thermo Fisher Scientific K.K.), at a thermal decomposition temperature of 590° C., with use of helium as carrier gas. As a result, the cationic structure contained in the branched portion of a polymer chain of resin was confirmed based on the obtained fragment peaks.

The electrophotographic member in Example 1 thus obtained was used as developing roller so as to be evaluated on the following items.

[Resistance Value of Developing Roller]

Figure 4:
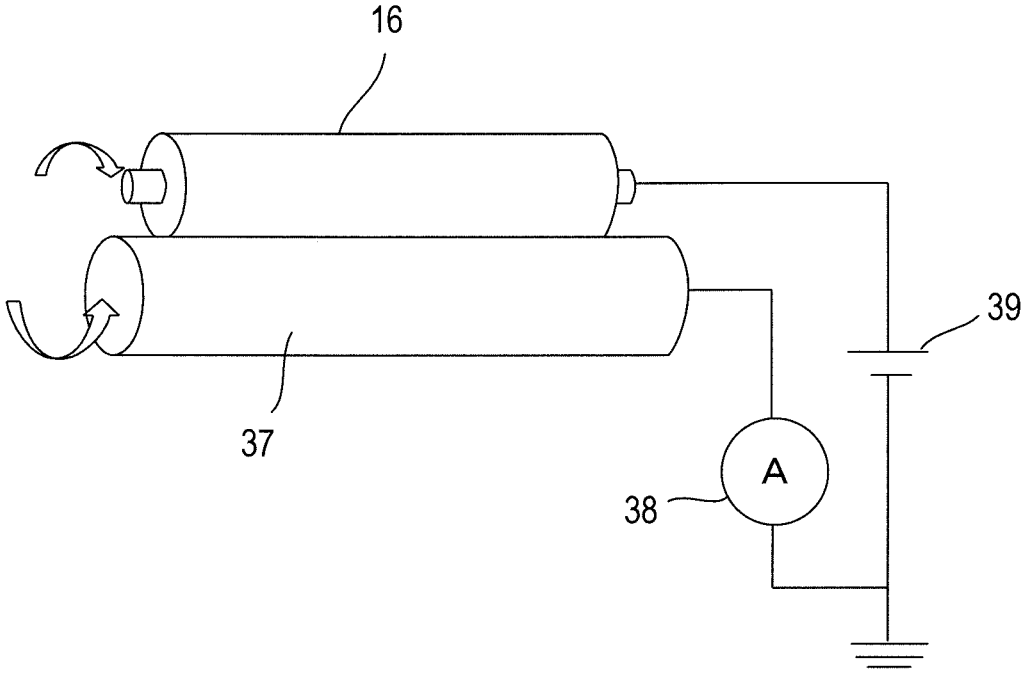
FIG. 4 is a schematic view illustrating a measurement apparatus for measuring the current value of a conductive roller in an embodiment of the electrophotographic member of the present invention.

As illustrated in FIG. 4, the current value flowing in the developing roller when a DC voltage was applied thereto was measured. As the electro-conductive layer has a higher conductivity (lower resistance), the current value flowing in the roller increases. Accordingly through measurement of the current value flowing in the developing roller when applied with a predetermined voltage, the conductivity of the electro-conductive layer can be evaluated. First, the developing roller 16 was placed on a cylindrical electrode 37 made of SUS having a diameter of 40 mm. Subsequently, 4.9 N loads were applied to exposed mandrel parts of the developing roller 16, respectively, so that the outer circumference of the developing roller 16 came in contact with the cylindrical electrode 37. In this state, the cylindrical electrode 37 was rotated, with the developing roller 16 being driven-rotated at a speed of 30 rpm. When the rotation was stabilized, a voltage of 50 V was applied between the cylindrical electrode 37 and the mandrel from a direct current power supply 39. On that occasion, the current values were measured around the whole circumference of the developing roller 16 with an ammeter 38. The average thereof was calculated as the current value flowing in the developing roller 16. The measurement was performed for a developing roller left standing in an environment at a temperature of 23° C. and a relative humidity of 55% for 6 hours or more, in an environment at a temperature of 23° C. and a relative humidity of 55%.

[Evaluation of Deformation Recovery (Amount of Residual Deformation)]

Figure 5:
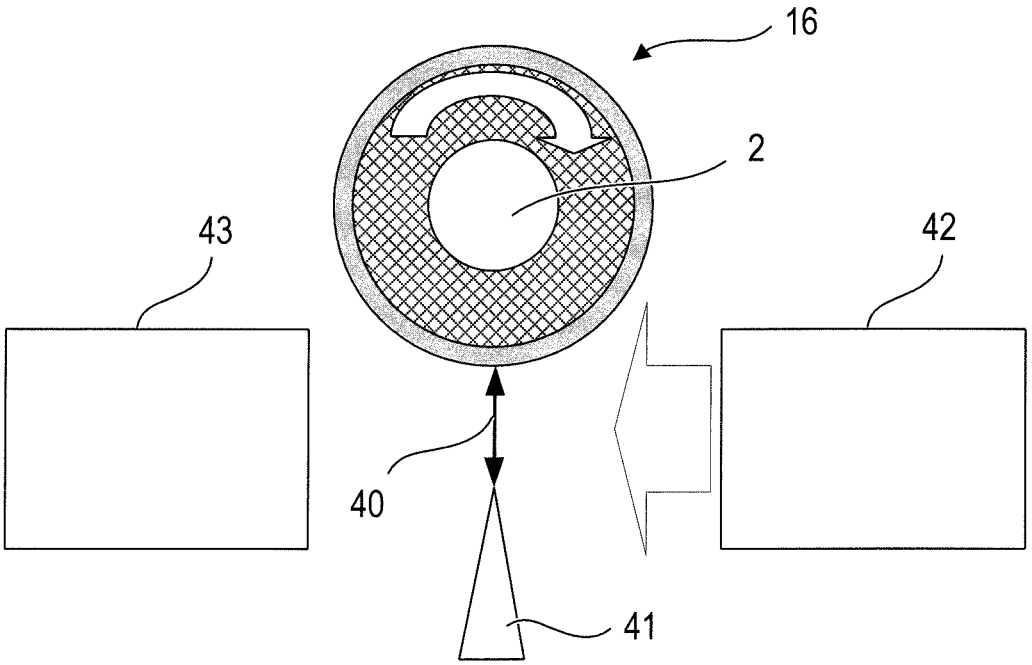
FIG. 5 is a schematic view illustrating an apparatus for evaluating the deformation recovery of a conductive roller in an embodiment of the electrophotographic member of the present invention.

First, the gap 40 between the developing roller obtained in the present Examples and a reference plate 41 with use of the apparatus in FIG. 5. The measurement apparatus includes a mandrel support (not illustrated in drawing) which rotates around the mandrel, an encoder (not illustrated in drawing) which detects the rotation of the mandrel, the reference plate 41, and an LED digital micrometer (trade name: LS-7000, manufactured by Keyence Corporation) including an LED emitter 42 and receiver 43.

While rotating the developing roller 16, the gap 40 between the surface of the developing roller 16 and the reference plate 41 was measured with the digital micrometer for 360 points at a pitch of 1° around the whole circumference of the developing roller 16. In addition the measurement of the gap 40 was performed for 3 points at the central part in the longitudinal direction and at the positions 20 mm away from each of the ends toward the central part in the longitudinal direction of the developing roller 16. The average value thereof was defined as the gap before left standing in a high temperature and high humidity environment. The measurement was performed for a developing roller left standing in an environment at a temperature of 23° C. and a relative humidity of 55%, for 6 hours or more, in an environment at 23° C. and a relative humidity of 55%.

The developing roller 16 measured in advance as described above was incorporated into a cyan cartridge for use in a laser printer (trade name: LBP 7700C, manufactured by Canon Inc.). In this case, the setting was change to stricter setting so that the contact pressure between the developing roller 16 and a developing blade was adjusted to 50 gf/cm by insertion of a spacer into the bearing surface of the developing blade.

Subsequently, the cartridge was left standing in a high temperature and high humidity environment (temperature: 40° C., relative humidity: 95%) for 30 days. The developing roller 16 was then removed from the cartridge and left standing under an environment at a temperature of 23° C. and a relative humidity of 55% for 6 hours. Subsequently, the gap 40 between the surface of the developing roller 16 and a reference plate 41 was measured in an environment at a temperature of 23° C. and a relative humidity of 55%.

The measurement was performed for the contact position of the developing blade at the same phase as in the measurement before left standing in the high temperature and high humidity environment. The change in the gap 40 before and after left standing in the high temperature and high humidity environment was obtained as the amount of residual deformation, which was defined as deformation recovery.

[Evaluation on Set Image of Developing Roller]

The developing roller after completion of the measurement of the amount of residual deformation was incorporated into the cyan cartridge of a laser printer (trade name: LBP 7700C, manufactured by Canon Inc.), so as to make a cartridge for image output testing.

The cartridge for image output testing was mounted on the laser printer, and a sheet with a halftone image was outputted. The obtained halftone image was evaluated according to the following criteria. The time period between the measurement of the amount of residual deformation and the output of a halftone image was set to 1 hour. The result is described in Table 11.

A: A uniform image was obtained.

B: Extremely slight density unevenness resulting from the deformation of the developing roller was observed.

C: Slight density unevenness resulting from the deformation of the developing roller was observed at the edge of, or over the whole of, an image.

D: Severe density unevenness resulting from the deformation of the developing roller was observed over the whole of an image.

Example 7

Another method for manufacturing the electrophotographic member of the present invention is described in the following.

The following materials were stirred and mixed as the materials for use in the electro-conductive layer as surface layer.

Reactive Compound

Reactive compound R-7 (terephthalic acid, manufactured by Tokyo Chemical Industry Co., Ltd.): 192.4 parts by mass.

Ion Conducting Agent

Ion conducting agent 1-11: 50.0 parts by mass.

Polymerization Catalyst

Antimony trioxide (trade name: PATOX-C, manufactured by Nihon Seiko Co., Ltd.): 0.01 parts by mass;

Urethane resin fine particles (trade name: ART PEARL C-400, manufactured by Negami Chemical Industrial Co., Ltd.): 90.0 parts by mass.

Subsequently, methyl ethyl ketone (hereinafter referred to as MEK) was added so as to have a total solid content ratio of 30 mass % based on the total content, and then mixed with a sand mill. Further, the viscosity was adjusted to 10 to 13 cps with MEK, so that a coating material for forming a surface layer was prepared.

An elastic roller D-1 prepared in advance was immersed in the coating material for forming the surface layer so as to form a coating film of the coating material on the surface of the elastic layer of the elastic roller D-1. The elastic layer was then dried, and subsequently heat-treated at a temperature of 250° C. for 1 hour, so that a surface layer having a film thickness of 15 μm was formed on the outer circumference of the elastic layer. The electrophotographic member in Example 7 was thus prepared.

Example 8

Another method for manufacturing the electrophotographic member of the present invention is described in the following.

The following materials were stirred and mixed as the materials for use in the electro-conductive layer as surface layer.

Reactive Compound

Reactive compound R-8 (2,4,6-tris[bis(methoxymethyl) amino]-1,3,5-triazine, manufactured by Tokyo Chemical Industry Co., Ltd.): 192.4 parts by mass.

Ion Conducting Agent

Ion conducting agent 1-12: 50.0 parts by mass.

Urethane resin fine particles (trade name: ART PEARL C-400, manufactured by Negami Chemical Industrial Co., Ltd.): 90.0 parts by mass.

Subsequently, methyl ethyl ketone (hereinafter referred to as MEK) was so as added to have a total solid content ratio of 30 mass % based on the total content, and then mixed with a sand mill. Further, the viscosity was adjusted to 10 to 13 cps with MEK, so that a coating material for forming a surface layer was prepared.

An elastic roller D-1 prepared in advance was immersed in the coating material for forming the surface layer so as to form a coating film of the coating material on the surface of the elastic layer of the elastic roller D-1. The elastic layer was then dried, and subsequently heat-treated at a temperature of 180° C. for 20 minutes, so that a surface layer having a film thickness of 15 μm was formed on the outer circumference of the elastic layer. The electrophotographic member in Example 8 was thus prepared.

Example 9

Another method for manufacturing the electrophotographic member of the present invention is described in the following.

The following materials were stirred and mixed as the materials for use in the electro-conductive layer as surface layer.

Reactive Compound

Reactive compound R-9 (2,2-bis(4-glycidyloxyphenyl) propane, manufactured by Tokyo Chemical Industry Co., Ltd.)): 192.4 parts by mass.

Ion Conducting Agent

Ion conducting agent 1-13: 50.0 parts by mass.

Urethane resin fine particles (trade name: ART PEARL C-400, manufactured by Negami Chemical Industrial Co., Ltd.): 90.0 parts by mass.

Subsequently, methyl ethyl ketone (hereinafter referred to as MEK) was added so as to have a total solid content ratio of 30 mass % based on a total content, and then mixed with a sand mill. Further, the viscosity was adjusted to 10 to 13 cps with MEK, so that a coating material for forming a surface layer was prepared.

An elastic roller D-1 prepared in advance was immersed in the coating material for forming the surface layer so as to form a coating film of the coating material on the surface of the elastic layer of the elastic roller D-1. The elastic layer was then dried, and subsequently heat-treated at a temperature of 180° C. for 2 hours, so that a surface layer having a film thickness of 15 μm was formed on the outer circumference of the elastic layer. The electrophotographic member in Example 9 was thus prepared.

Examples 2 to 6, and 10 to 27

A coating material for forming the surface layer was prepared in the same way as in Example 1, except that the ion conducting agent, the reactive compound and polyol as the materials for use in the electro-conductive layer as surface layer in Example 1 were replaced with the materials described in the following Tables 7 to 9 for use with the amount added described in the following Tables 7 to 9. The urethane fine particles (trade name: ART PEARL C-400, manufactured by Negami Chemical Industrial Co., Ltd.) in an amount of 90.0 parts by mass was used in any of the Examples in the same way as in Example 1. Each of the coating materials was applied to the elastic roller D-1, dried and heated in the same way as in Example 1. The electrophotographic members in Examples 2 to 6 and 10 to 27 were thus prepared.

Example 28

A coating material for forming the surface layer was prepared in the same way as in Example 1. The electrophotographic member in Example 28 was prepared by coating, drying and heating in the same way as in Example 1, except that the elastic roller D-1 was replaced with an elastic roller D-2.

TABLE 7

| Reactive compound | |
|---|---|
| R-4 | TDI (trade name: COSMONATE T80; manufactured by Mitsui Chemicals, Inc.) |
| R-5 | pure-MDI (trade name: MILLIONATE MT; manufactured by Nippon Polyurethane Industries Co., Ltd.) |
| R-6 | Polymeric MDI (trade name: MILLIONATE MR; manufactured by Nippon Polyurethane Industries Co., Ltd.) |
| R-7 | Terephthalic acid (manufactured by Tokyo Chemical Industry Co., Ltd.) |
| R-8 | 2,4,6-Tris[bis(methoxymethyl)amino]-1,3,5-triazine (manufactured by Tokyo Chemical Industry Co., Ltd.) |
| R-9 | 2,2-Bis(4-glycidyloxyphenyl)propane (manufactured by Tokyo Chemical Industry Co., Ltd.) |

TABLE 8

| Polyol | |
|---|---|
| O-1 | Polypropylene glycol-based polyol (trade name: SANIX PP-1000: manufactured by Sanyo Chemical Industries, Ltd.) |
| O-2 | PTG-L1000 (manufactured by Hodogaya Chemical Co., Ltd.) |
| O-3 | PTG-L2000 (manufactured by Hodogaya Chemical Co., Ltd.) |
| O-4 | NEWPOL NP-400 (manufactured by Sanyo Chemical Industries, Ltd.) |

TABLE 9

| | Ion conducting agent | Amount added (parts by mass) | Reactive compound | Amount added (parts by mass) | Polyol | Amount added (parts by mass) |
|---|---|---|---|---|---|---|
| Example 1 | 1-5 | 162.3 | R-5 | 105.9 | none | 0.0 |
| Example 2 | 1-6 | 11.1 | R-6 | 47.9 | O-3 | 174.0 |
| Example 3 | 1-7 | 11.1 | B-1 | 138.4 | O-1 | 83.8 |
| Example 4 | 1-8 | 4.5 | B-2 | 141.5 | O-4 | 85.8 |
| Example 5 | 1-9 | 4.5 | B-1 | 200.8 | O-2 | 26.5 |
| Example 6 | 1-10 | 4.5 | B-1 | 141.5 | O-2 | 85.8 |
| Example 7 | 1-11 | 50.0 | R-7 | 192.4 | none | 0.0 |
| Example 8 | 1-12 | 50.0 | R-8 | 192.4 | none | 0.0 |
| Example 9 | 1-13 | 50.0 | R-9 | 192.4 | none | 0.0 |
| Example 10 | 2-4 | 168.5 | R-4 | 101.4 | none | 0.0 |
| Example 11 | 2-5 | 11.1 | R-6 | 47.9 | O-2 | 174.3 |
| Example 12 | 2-6 | 11.1 | B-1 | 26.9 | O-2 | 195.4 |
| Example 13 | 2-7 | 4.5 | B-2 | 141.5 | O-4 | 85.8 |
| Example 14 | 2-8 | 4.5 | B-1 | 143.9 | O-2 | 83.4 |
| Example 15 | 2-9 | 1.1 | B-1 | 143.1 | O-2 | 86.7 |
| Example 16 | 3-1 | 11.1 | B-1 | 138.4 | O-2 | 83.9 |
| Example 17 | 3-2 | 21.4 | B-1 | 133.4 | O-2 | 80.9 |
| Example 18 | 4-1 | 11.1 | B-1 | 168.7 | O-2 | 53.5 |
| Example 19 | 4-2 | 11.1 | B-1 | 138.4 | O-2 | 83.9 |
| Example 20 | 5-1 | 11.1 | B-1 | 138.4 | O-2 | 83.9 |
| Example 21 | 5-2 | 11.1 | B-1 | 138.4 | O-2 | 83.9 |
| Example 22 | 6-1 | 11.1 | B-1 | 138.4 | O-2 | 83.9 |
| Example 23 | 7-1 | 11.1 | B-1 | 138.4 | O-2 | 83.9 |
| Example 24 | 8-1 | 11.1 | B-1 | 138.4 | O-2 | 83.9 |
| Example 25 | 8-2 | 11.1 | B-1 | 138.4 | O-2 | 83.9 |
| Example 26 | 9-1 | 1.1 | B-1 | 143.1 | O-2 | 86.7 |
| Example 27 | 9-2 | 1.1 | B-1 | 143.1 | O-2 | 86.7 |

Comparative Example 1

As the materials of a surface layer, 1.1 parts by mass of an ion conducting agent 1-1 (tetrabutylammonium bis(trifluoromethanesulfonyl)imide, 86.7 parts by mass of PTG-L2000, and 90.0 parts by mass of urethane resin fine particles (trade name: ART PEARL C-400, manufactured by Negami Chemical Industrial Co., Ltd.), relative to 143.1 parts by mass of an isocyanate group terminal prepolymer B-1, were stirred and mixed.

A coating material for forming a surface layer in Comparative Example 1 was then prepared in the same way as in the method for preparing the coating material for forming the surface layer in Example 1. The coating material for forming a surface layer was applied to the surface of the silicone rubber elastic layer of the elastic roller D-1 and dried to form a surface layer in the same way as in Example 1, so that the electrophotographic member in Comparative Example 1 was prepared.

Comparative Examples 2 to 7

A coating material for forming a surface layer was prepared in the same way as in Example 1, except that the ion conducting agent, the reactive compound and polyol as the materials of the surface layer in Example 1 were replaced with the materials described in the following Table 10 for use with the amount added described in the Table. The urethane fine particles (trade name: ART PEARL C-400, manufactured by Negami Chemical Industrial Co., Ltd.) in an amount of 90 parts by mass was used in any of the Examples in the same way as in Example 1. Each of the coating materials was applied to the elastic roller, dried and heated in the same way as in Example 1. The electrophotographic members in Comparative Examples 2 to 7 were thus prepared.

TABLE 10

| | Ion conducting agent | Amount added (parts by mass) | Reactive compound | Amount added (parts by mass) | Polyol | Amount added (parts by mass) |
|---|---|---|---|---|---|---|
| Comparative Example 1 | 1-1 | 1.1 | B-1 | 143.1 | O-3 | 86.7 |
| Comparative Example 2 | 1-2 | 1.1 | B-1 | 143.1 | O-3 | 86.7 |
| Comparative Example 3 | 1-3 | 1.1 | B-1 | 143.1 | O-3 | 86.7 |
| Comparative Example 4 | 1-4 | 162.3 | R-5 | 105.9 | none | 0.0 |
| Comparative Example 5 | 2-1 | 1.1 | B-1 | 143.1 | O-3 | 86.7 |
| Comparative Example 6 | 2-2 | 1.1 | B-1 | 143.1 | O-3 | 86.7 |
| Comparative Example 7 | 2-3 | 168.5 | R-4 | 101.4 | none | 0.0 |

Comparative Example 8

An electrophotographic member in Comparative Example 8 was prepared in the same way as in Example 28, except that the materials in Comparative Example 1 were used for forming the surface layer.

Each of the electrophotographic members in Examples 2 to 27 and Comparative Examples 1 to 7 as a developing roller was evaluated in the same way as in Example 1. The results are described in Table 11 and Table 12.

TABLE 11

| | | Cation structure | | | | | Evaluation result | | |
|---|---|---|---|---|---|---|---|---|---|
| Example | Ion conducting agent | Cation skeleton | Number of hydroxyl groups | Anion structure | Reactive compound | Polyol | Current value (μA) | Amount of residual deformation (μm) | Set image |
| 1 | 1-5 | Ammonium | 3 | $(CF_3SO_2)_2N^-$ | R-5 | none | 352 | 5 | B |
| 2 | 1-6 | Ammonium | 3 | $CF_3SO_3^-$ | R-6 | O-3 | 334 | 5 | B |
| 3 | 1-7 | Ammonium | 4 | $(FSO_2)_2N^-$ | B-1 | O-1 | 369 | 4 | B |
| 4 | 1-8 | Ammonium | 5 | $(CF_3SO_2)_2N^-$ | B-2 | O-4 | 352 | 3 | A |
| 5 | 1-9 | Ammonium | 5 | $(C_4F_9SO_2)_2N^-$ | B-1 | O-2 | 325 | 3 | A |
| 6 | 1-10 | Ammonium | 6 | $N(CN)_2^-$ | R-7 | none | 141 | 2 | A |
| 7 | 1-11 | Ammonium | 3 | $(CF_3SO_2)_3C^-$ | R-8 | none | 313 | 5 | B |
| 8 | 1-12 | Ammonium | 4 | $C_3F_7SO_3^-$ | R-9 | none | 321 | 4 | B |
| 9 | 1-13 | Ammonium | 4 | $CF_3COO^-$ | R-4 | none | 297 | 4 | B |
| 10 | 2-4 | Imidazolium | 3 | $CF_2(CF_2SO_2)_2N^-$ | R-4 | none | 361 | 5 | B |
| 11 | 2-5 | Imidazolium | 4 | $BF_3(C_2F_5)^-$ | R-6 | O-2 | 137 | 4 | B |

TABLE 11-continued

| Example | Ion conducting agent | Cation structure: Cation skeleton | Cation structure: Number of hydroxyl groups | Cation structure: Anion structure | Reactive compound | Polyol | Evaluation result: Current value (μA) | Evaluation result: Amount of residual deformation (μm) | Evaluation result: Set image |
|---|---|---|---|---|---|---|---|---|---|
| 12 | 2-6 | Imidazolium | 4 | $PF_6^-$ | B-1 | O-2 | 106 | 4 | B |
| 13 | 2-7 | Imidazolium | 5 | $SbF_6^-$ | B-2 | O-4 | 100 | 3 | A |
| 14 | 2-8 | Imidazolium | 3 | $AsF_6^-$ | B-1 | O-2 | 106 | 5 | B |
| 15 | 2-9 | Imidazolium | 4 | $(C_2O_4)_2B^-$ | B-1 | O-2 | 102 | 4 | B |
| 16 | 3-1 | Pyridinium | 3 | $(CF_3SO_2)_2N^-$ | B-1 | O-2 | 141 | 5 | B |
| 17 | 3-2 | Pyridinium | 3 | $CF_3SO_3^-$ | B-1 | O-2 | 134 | 5 | B |
| 18 | 4-1 | Pyrrolidinium | 3 | $(FSO_2)_2N^-$ | B-1 | O-2 | 177 | 5 | B |
| 19 | 4-2 | Pyrrolidinium | 5 | $N(CN)_2^-$ | B-1 | O-2 | 177 | 3 | A |
| 20 | 5-1 | Piperidinium | 3 | $(CF_3SO_2)_3C^-$ | B-1 | O-2 | 144 | 5 | B |
| 21 | 5-2 | Piperidinium | 5 | $CF_3COO^-$ | B-1 | O-2 | 137 | 3 | A |
| 22 | 6-1 | Morpholinium | 3 | $CF_2(CF_2SO_2)_2N^-$ | B-1 | O-2 | 177 | 5 | B |
| 23 | 7-1 | Pyrazolium | 3 | $BF_3(C_2F_5)^-$ | B-1 | O-2 | 99 | 5 | B |
| 24 | 8-1 | Sulfonium | 4 | $PF_6^-$ | B-1 | O-2 | 42 | 4 | B |
| 25 | 8-2 | Sulfonium | 3 | $SbF_6^-$ | B-1 | O-2 | 40 | 5 | B |
| 26 | 9-1 | Phosphonium | 4 | $AsF_6^-$ | B-1 | O-2 | 48 | 4 | B |
| 27 | 9-2 | Phosphonium | 5 | $(C_2O_4)_2B^-$ | B-1 | O-2 | 46 | 3 | A |

TABLE 12

| Comparative Example | Ion conducting agent | Cation structure: Cation skeleton | Cation structure: Number of hydroxyl groups | Cation structure: Anion structure | Reactive compound | Polyol | Evaluation results: Current value (μA) | Evaluation results: Amount of residual deformation (μm) | Evaluation results: Set image |
|---|---|---|---|---|---|---|---|---|---|
| 1 | 1-1 | Ammonium | 0 | $CF_3SO_3^-$ | B-1 | O-3 | 101 | 13 | D |
| 2 | 1-2 | Ammonium | 1 | $(CF_3SO_2)_2N^-$ | B-1 | O-3 | 143 | 8 | D |
| 3 | 1-3 | Ammonium | 2 | $(CF_3SO_2)_2N^-$ | B-1 | O-3 | 143 | 7 | D |
| 4 | 1-4 | Ammonium | 3 | $ClO_4^-$ | R-5 | none | 46 | 9 | D |
| 5 | 2-1 | Imidazolium | 0 | $(CF_3SO_2)_2N^-$ | B-1 | O-3 | 286 | 10 | D |
| 6 | 2-2 | Imidazolium | 2 | $(CF_3SO_2)_2N^-$ | B-1 | O-3 | 245 | 8 | D |
| 7 | 2-3 | Imidazolium | 3 | $Cl^-$ | R-4 | none | 29 | 9 | D |

In Examples 1 to 27, the surface layer contains the resin of the present invention, so that the amount of residual deformation was small after left standing in a high temperature and high humidity environment for a long period, resulting in a high quality image.

In particular, the resins in Examples 1 to 23 employ the ion conducting agent having any one structure selected from the group consisting of structural formulas (1) to (7). The electrophotographic member having a surface layer including the resin had a small amount of residual deformation, resulting in a high quality image.

Further, the resins in Examples 1 to 15 employ the ion conducting agent having either one structure selected from the group consisting of structural formulas (1) and (2). The electrophotographic member having a surface layer including the resin had a particularly small amount of residual deformation, resulting in a high quality image.

In contrast, the electrophotographic members in Comparative Examples 1 to 3, 5 and 6, with an ion conducting agent having two or less hydroxyl groups, had a large amount of residual deformation after left standing in a high temperature and high humidity environment for a long period, causing an image defect.

The electrophotographic members in Comparative Examples 4 and 7, with an ion conducting agent different from the specific anions of the present invention, had a large amount of residual deformation, causing an image defect.

The electrophotographic members prepared in Example 28 as a charging roller was evaluated on the following items.

[Resistance Value of Charging Roller]

The resistance value of the charging roller in Example 28 was measured in the same way as in the measurement of the resistance value of the developing roller 16 with use of the apparatus in FIG. 4, except that the developing roller 16 was replaced with a charging roller prepared in Example 28.

[Evaluation of Deformation Recovery (Amount of Residual Deformation) of Charging Roller]

First, the gap 40 between the charging roller and a reference plate 41 was measured with use of an apparatus in FIG. 5, with the developing roller 16 in FIG. 5 being replaced with the charging roller in Example 28. The measurement apparatus includes a mandrel support (not illustrated in drawing) which rotates around the mandrel, an encoder (not illustrated in drawing) which detects the rotation of the mandrel, the reference plate 41, and an LED digital micrometer (trade name: LS-7000, manufactured by Keyence Corporation) including an LED emitter 42 and receiver 43.

While rotating the charging roller, the gap 40 between the surface of the charging roller and the reference plate 41 was measured with the digital micrometer for 360 points at a pitch of 1° around the whole circumference of the charging roller. The measurement of the gap 40 was performed for 3 points at the central part in the longitudinal direction and at the positions 20 mm away from each of the ends toward the central part in the longitudinal direction of the charging roller. The average value thereof was defined as the gap before left standing in a high temperature and high humidity environment. The measurement was performed for a charging roller left standing in an environment at a temperature of 23° C. and a relative humidity of 55% for 6 hours or more, in an environment at 23° C. and a relative humidity of 55%.

The charging roller measured in advance as described above was incorporated into a cyan cartridge for use in a laser printer (trade name: LBP 7700C, manufactured by Canon Inc.). In this case, the setting was change to stricter setting so that the contact pressure between the charging roller and a photosensitive member was adjusted to 50 gf/cm.

Subsequently, the cartridge was left standing in a high temperature and high humidity environment (temperature: 40° C., relative humidity: 95%) for 30 days. The charging roller was then removed from the cartridge and left standing under an environment at a temperature of 23° C. and a relative humidity of 55% for 6 hours. Subsequently, the gap 40 between the surface of the charging roller and the reference plate was measured in an environment at a temperature of 23° C. and a relative humidity of 55%.

The measurement was performed for the contact position of the photosensitive member at the same phase as in the measurement before left standing in the high temperature and high humidity environment. The change in the gap 40 before and after left standing in the high temperature and high humidity environment was obtained as the amount of residual deformation, which was defined as deformation recovery.

[Evaluation on Set Image of Charging Roller]

After completion of the measurement of the amount of residual deformation, the charging roller was incorporated into the cyan cartridge of a laser printer (trade name: LBP 7700C, manufactured by Canon Inc.), so as to make a cartridge for image output testing.

The cartridge for image output testing was mounted on the laser printer, and a sheet with a halftone image was outputted. The obtained halftone image was evaluated according to the following criteria. The time period between the measurement of the amount of residual deformation and the output of a halftone image was set to 1 hour.

A: A uniform image was obtained.

B: Extremely slight density unevenness resulting from the deformation of the charging roller was observed.

C: Slight density unevenness resulting from the deformation of the charging roller was observed at the edge of, or over the whole of, an image.

D: Severe density unevenness resulting from the deformation of the charging roller was observed over the whole of an image.

Further, the electrophotographic member in Comparative Example 8 as charging roller was evaluated on the resistance value, the deformation recovery and set image in the same way as in the evaluation of the electrophotographic member in Example 28. The results are described in Table 13.

TABLE 13

| | | Cation structure | | | | | Evaluation results | | |
|---|---|---|---|---|---|---|---|---|---|
| | Ion conducting agent | Cation skeleton | Number of hydroxyl groups | Anion structure | Reactive compound | Polyol | Current value (μA) | Amount of residual deformation (μm) | Set image |
| Example 28 | 1-5 | Ammonium | 3 | $(CF_3SO_2)_2N^-$ | R-5 | none | 97 | 5 | A |
| Comparative Example 8 | 1-1 | Ammonium | 0 | $CF_3SO_3^-$ | B-1 | O-3 | 679 | 11 | D |

The electrophotographic member in Example 28 with use of an ion conducting agent having three hydroxyl groups had a small amount of residual deformation, resulting in a high quality image. The electrophotographic member in Comparative Example 8 had a large amount of residual deformation, causing an image defect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-101642, filed May 15, 2014, and Japanese Patent Application No. 2015-097742, filed May 12, 2015, which are hereby incorporated by reference herein in their entirety.

What is claimed is:

1. An electrophotographic member comprising an electro-conductive mandrel and an electro-conductive layer, the electro-conductive layer comprising:

at least one anion selected from the group consisting of a fluorinated sulfonate anion, a fluorinated carboxylate anion, a fluorinated sulfonylimide anion, a fluorinated sulfonylmethide anion, a dicyanamide anion, a fluorinated alkylfluoroborate anion, a fluorinated phosphate anion, a fluorinated antimonate anion, a fluorinated arsenate anion, and bis(oxalato)borate anion; and a resin having at least one cationic structure selected from the group consisting of formulae (1) to (3) and (16) to (18)

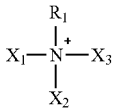

(1)

where $X_1$ to $X_3$ independently represent a structure comprising a portion bonding to a resin through a bond selected from the group consisting of an ether bond, an ester bond and a urethane bond; and $R_1$ is selected from the group consisting of (a) to (c)

(a) a hydrogen atom;

(b) a hydrocarbon group having 1 to 30 carbon atoms; and (c) a structure comprising a portion bonding to a resin through a bond selected from the group consisting of an ether bond, an ester bond and a urethane bond;

(2)

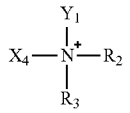

where $R_2$ and $R_3$ are independently selected from the group consisting of (a) to (c); $X_4$ represents a structure comprising a portion bonding to a resin through a bond selected from the group consisting of an ether bond, an ester bond and a urethane bond; and $Y_1$ is one of formulae (14) and (15)

(14)

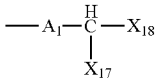

(15)

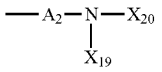

where $A_1$ and $A_2$ independently represent a hydrocarbon group or an alkylene ether group; and $X_{17}$ to $X_{20}$ independently represent a structure comprising a portion bonding to a resin through a bond selected from the group consisting of an ether bond, an ester bond and a urethane bond;

(3)

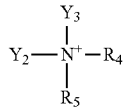

where $Y_2$ and $Y_3$ independently represent formulae (14) or (15); and $R_4$ and $R_5$ independently represent (a) to (c);

(16)

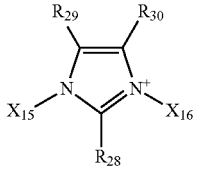

where $X_{15}$ and $X_{16}$ independently represent a structure comprising a portion bonding to a resin through a bond selected from the group consisting of an ether bond, an ester bond and a urethane bond; and $R_{28}$ to $R_{30}$ independently represent one of (a) to (c), provided that at least one of $R_{28}$ to $R_{30}$ is (c)

(a) a hydrogen atom;

(b) a hydrocarbon group having 1 to 30 carbon atoms; and (c) a structure comprising a portion bonding to a resin through a bond selected from the group consisting of an ether bond, an ester bond and a urethane bond;

(17)

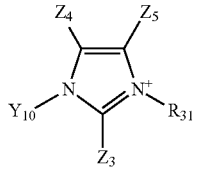

where $Y_{10}$ is formulae (14) or (15); $Z_3$, $Z_4$ and $Z_5$ independently represent a hydrogen atom or a hydrocarbon group having 1 to 30 carbon atoms; and $R_{31}$ represents a structure comprising a portion bonding to a resin through a bond selected from the group consisting of an ether bond, an ester bond, and a urethane bond, or is formulae (14) or (15); and (18)

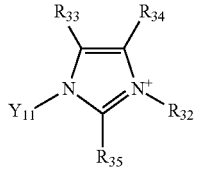

where $Y_{11}$ is formulae (14) or (15); $R_{32}$ is one of (a) to (c), or is formulae (14) or (15); and $R_{33}$ to $R_{35}$ independently represent one of (a) to (c), provided that at least one of $R_{33}$ to $R_{35}$ is (c).

2. The electrophotographic member according to claim 1, wherein the cationic structure comprises at least one of formulae (1) to (3).

3. The electrophotographic member according to claim 1, wherein the cationic structure comprises at least one of formulae (16) to (18).

4. A process cartridge comprising at least one of a charging member and a developing member, being adapted to be detachably attached to a main body of an electrophotographic apparatus; the charging member or the developing member being the electrophotographic member according to claim 1.

5. An electrophotographic apparatus comprising an electrophotographic photosensitive member, a charging member and a developing member; the charging member or the developing member being the electrophotographic member according to claim 1.

* * * * *